United States Patent [19]

Fish

[11] 4,349,071

[45] Sep. 14, 1982

[54] CEMENT RETAINER AND SETTING TOOL ASSEMBLY

[75] Inventor: David W. Fish, Carrollton, Tex.

[73] Assignee: Dresser Industries, Inc., Dallas, Tex.

[21] Appl. No.: 204,750

[22] Filed: Nov. 7, 1980

[51] Int. Cl.[3] ..... E21B 23/06; E21B 33/129; E21B 34/12

[52] U.S. Cl. ..... 166/124; 166/125; 166/128; 166/137; 166/215; 166/334

[58] Field of Search ..... 166/124, 125, 128, 137, 166/138, 140, 215, 216, 217, 237, 240, 332, 334

[56] References Cited

U.S. PATENT DOCUMENTS

| | | | |
|---|---|---|---|
| 3,306,366 | 2/1967 | Muse | 166/128 |
| 3,387,659 | 6/1968 | Current | 166/125 |
| 3,448,806 | 6/1969 | Berryman et al. | 166/216 |
| 3,465,821 | 9/1969 | Berryman | 166/237 |
| 3,915,226 | 10/1975 | Savage | 166/153 |
| 4,253,521 | 3/1981 | Savage | 166/128 |

FOREIGN PATENT DOCUMENTS

| | | | |
|---|---|---|---|
| 667670 | 7/1963 | Canada | 166/124 |
| 1003233 | 9/1965 | United Kingdom | 166/124 |

*Primary Examiner*—Stephen J. Novosad

*Attorney, Agent, or Firm*—J. N. Hazelwood; W. R. Peoples

[57] ABSTRACT

A well tool assembly comprising a drillable cement retainer and setting tool includes a connection between a setting-tool mandrel and a retainer mandrel allowing for opening and closing of a cement valve in the retainer without disconnecting the setting tool from the retainer. A releasable locking mechanism in the connection keeps a tubular connector between the setting-tool mandrel and the retainer mandrel locked against sliding relative to one of the mandrels prior to deploying an upper slip set of the cement retainer. Additionally, a carrier in the setting tool includes radially resilient lugs connected between the setting-tool mandrel and a retaining sleeve for the upper slip set for sliding upwardly on the setting-tool mandrel to carry the sleeve into an upper position releasing the upper slip set for deployment. A set lock in the retainer holds the retainer mandrel against movement downwardly once the retainer is anchored in the well.

49 Claims, 30 Drawing Figures

FIG. 2a
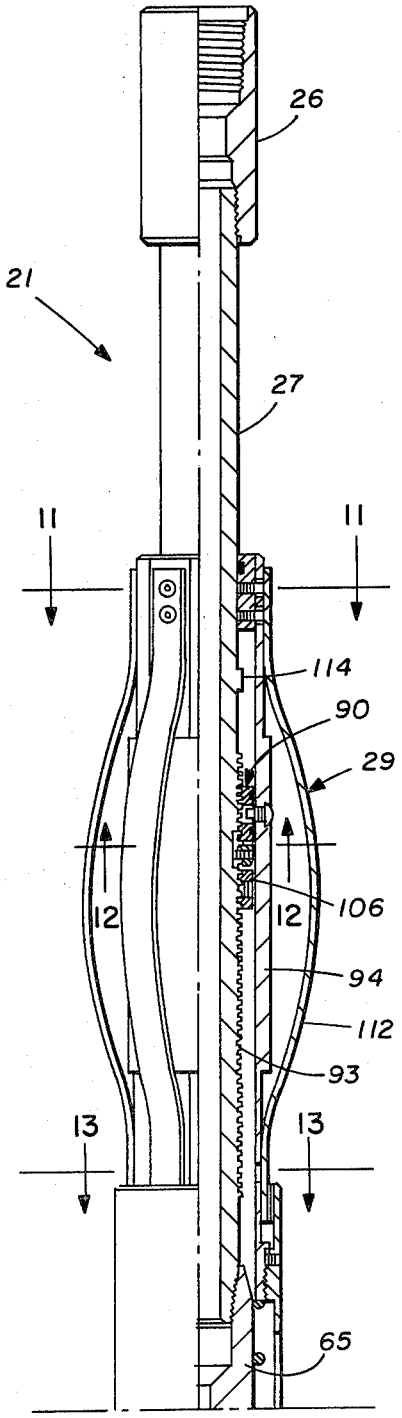
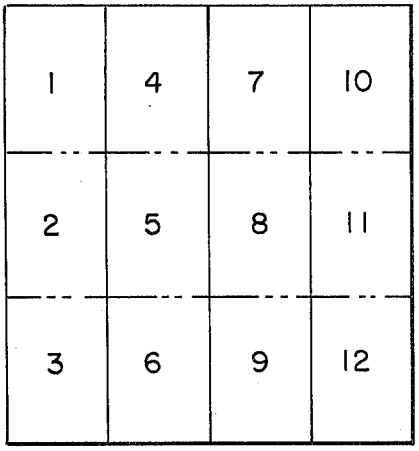
FIG. 1
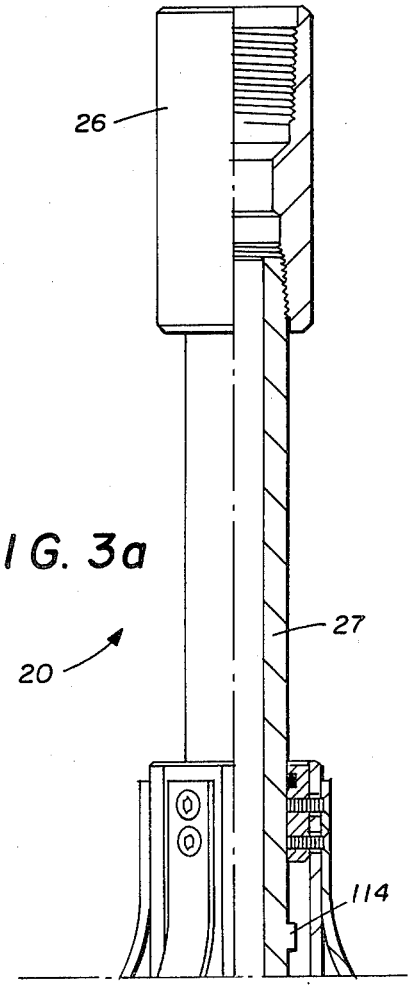
FIG. 3a

FIG. 10a
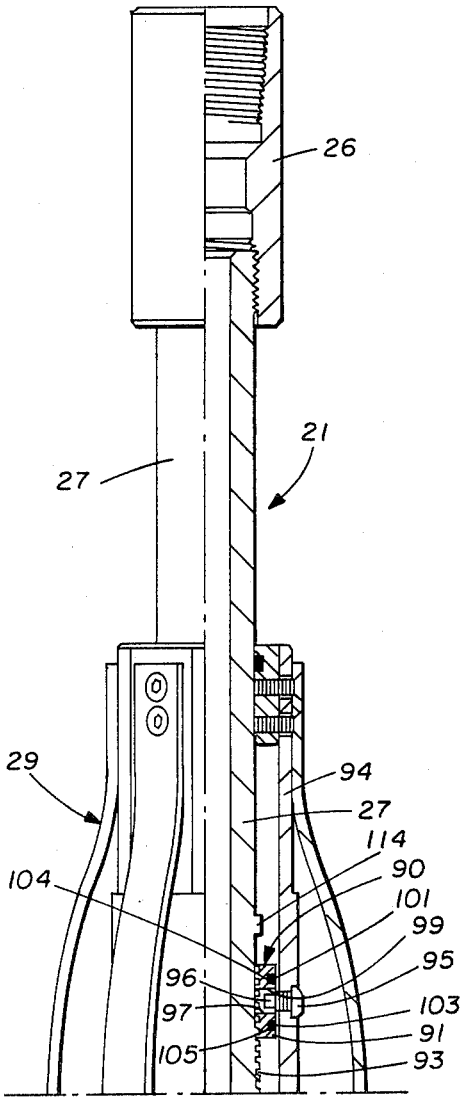
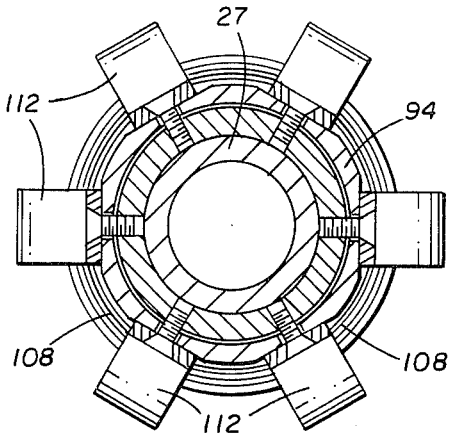
FIG. 11
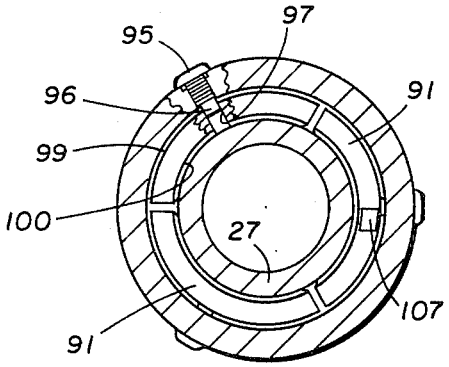
FIG. 12
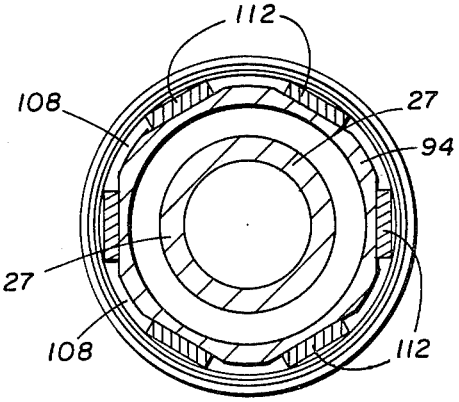
FIG. 13

CEMENT RETAINER AND SETTING TOOL ASSEMBLY

TECHNICAL FIELD

This invention relates to a well tool assembly including a setting tool and a well tool such as a cement retainer, packer or like device which includes a slip set adapted to be deployed by the setting tool to anchor the well tool in the casing of the well. In a cement retainer, an actuator serves to open and close a cement valve through which cement may flow into the well beneath the retainer.

BACKGROUND ART

Typically, a cement retainer is used in an oil or gas well at the upper limit of a section of the well casing which is to be treated with cement for closing leaks or perforations. In preparing a well for cementing, an assembly comprising a mechanical setting tool and a cement retainer is lowered with the tubing string into the well to a position located immediately above the section of the well to be cemented. Desirably, as the assembly is lowered, a cement valve in the retainer is held open to the passage of well fluids so as to ease lowering of the assembly into the well. Once located in the desired position, the tubing string carrying the assembly is manipulated to cause the slip set carried by the retainer to deploy and anchor the retainer within the casing. At the same time that the slips are set, sealing elements in the retainer are compressed axially to expand radially outward and thereby seal between the tubing string and the casing. This keeps cement from flowing upwardly in the annulus between the tubing string and the interior of the casing when the cement is forced under pressure from the bottom of the retainer into the well section. To make sure that cement does not leak from the tubing string or across the packing elements during cementing, both the tubing string and the annulus are usually pressure tested separately before cementing..

The usual procedure for cementing also requires that the setting tool be disconnected from the retainer to spot the cement in the well with the valve closed. Cement spotting involves pumping of a quantity cement through the tubing and discharging the volume of well fluid displaced by the cement from the annulus at the top of the well. Once the cement reaches the lower end of the tubing string, as determined by the volume of well fluid displaced from the annulus, the tubing string is reconnected to the retainer and the valve is opened. This procedure avoids forcing excess fluid into the formation where the leaks or perforations are located. After a measured quantity of cement is injected into the well, it is desirable to quickly disconnect the setting tool from the retainer and coincidently therewith close the valve. Quick disconnection avoids cementing the setting tool in the retainer and the closing of the valve is important to keep cement from being forced back through the valve by pressure in the well beneath the retainer.

Different examples of prior cement retainers are disclosed in U.S. Pat. Nos. 3,387,659, 3,448,806 and 3,465,821. The cement retainer and setting tool assembly shown in U.S. Pat. No. 3,465,821 includes a set of upper slips confined in a running-in position by a slip retainer sleeve whose lower end portion is telescoped over an upper end portion of the slips. A drag mechanism above the sleeve includes a threaded connection with a control sleeve which in turn, is releasably latched with an operating mandrel connected to the tubing string carrying the assembly so that, once the assembly is positioned properly in the well, rotation of the tubing string causes the sleeve to move upwardly on the control sleeve freeing the slips to be set against the interior wall of the well casing. At the same time, the latch between the control sleeve and the mandrel is released and, thereafter, an upward pull on the tubing string lifts the cement retainer with the upper slips abutting the lower end of the control sleeve so as to be wedged outwardly and anchored against the interior wall of the casing.

A releasable connection provided by abutment between coupling lugs on a tubular extension of the operating mandrel and shoulders on another mandrel in the retainer disclosed in patent 3,465,821 serves to transmit upward force from the tubing string to the retainer for setting the slips. The lugs and shoulders are spaced angularly around the respective members to which they are attached and index pins on the retainer mandrel riding within slots in the operating mandrel extension cause the mandrel to rotate between indexed positions as the tubing string is alternately raised and lowered. In this manner, the lugs are positioned relative to the shoulders so they either engage or avoid engagement with each other as the tubing string is lifted. When the lugs and shoulders are positioned to avoid engagement with each other, the setting tool may be disconnected from the retainer by lifting on the tubing string. Rotation of the tubing string by indexing of the pins in the slots also opens and closes a valve in the retainer. The indexing is such that the valve remains closed when the lugs and shoulders are positioned to avoid engagement.

In service use of foregoing arrangement, after testing or spotting cement and reconnecting the setting tool with the cement retainer to squeeze cement through the retainer, it is necessary to manipulate the tubing string up, down and back up again before the setting tool will disconnect from the cement retainer. The first upward movement of the tubing string is for closing the valve and the following downward and upward actions are to index the relative positions of the lugs and shoulders so they avoid engaging each other when the tubing string and setting tool are pulled from the well.

U.S. Pat. No. 3,448,806 discloses a cement retainer and setting tool assembly which is similar to the one disclosed in U.S. Pat No. 3,465,821, at least with respect to the arrangement for setting the slips. In the arrangement disclosed in U.S. Pat. No. 3,448,806, however, the valve at the lower end of the retainer is opened and closed by vertical movement of a mandrel extension which releasably connects with a vertically movable valve sleeve. In a lower position of the sleeve, the valve is opened, and in an upper position, the valve is closed. Latch fingers provide the connection between the mandrel extension and the valve sleeve for pushing the sleeve into its lower open position such as when the valve is opened after pressure testing. The fingers release from the mandrel when it is raised and a coil spring urges against the underside of the valve sleeve to push it upwardly into its closed position when the fingers are released. In order to change the position of the valve sleeve from the position it is in when the retainer is being lowered into the well, it is necessary first to set the slips on the cement retainer and then rotate the tubing string. This rotation both shears a pin and causes a ratchet nut to move upwardly from a locked position connecting the setting tool with the retainer mandrel into a release position within which the tubing string may be moved vertically to either open or close the valve as desired.

The cement retainer and setting tool assembly disclosed in the aforementioned U.S. Pat. No. 3,387,659 is functionally similar to the assemblies described above. In the assembly disclosed in patent 3,387,659, however, slips carried by the retainer are set initially against the interior wall of a well casing by the force stored in a coil spring which acts through a drag mechanism to urge a setting sleeve downwardly against the slips. While the assembly is being run in the well on the lower end of a tubing string the spring is held compressed between a tension nut and a hydraulic piston. The latter is supported upwardly against the lower end of the spring by hydraulic fluid captivated in a chamber below the piston. Rotation of the tubing string carrying the assembly releases the fluid, allowing the spring to shift the drag mechanism downwardly against the setting sleeve. The latter, in turn, is pushed by the mechanism to initially set the slips. Thereafter, an upward pull on the tubing string causes the slips to set further, packing off the retainer in the well. The upward force for anchoring the slips securely in the casing is transmitted from an operating mandrel of the setting tool, to a separate mandrel in the cement retainer through a connection which includes a frangible pin, a pair of spring biased latching dogs and abutting shoulders. The latching dogs and abutting shoulders are connected to the operating mandrel and the retainer mandrel, respectively. When running the assembly into the well casing with the retainer valve held open, the frangible pin serves to support the shoulers in a spaced relationship but in setting the slips, lifting on the tubing string fractures the pin and the operating mandrel and the retainer mandrel slide relative to each other until the shoulders contact each other. As the mandrels slide, an actuator connected to the valve is lifted thereby closing the valve. Once the pin is broken, instead of upward setting force being transmitted through the pin and the latching dogs, the force is transmitted through the abutting shoulders and the latching dogs. In order to release the latching dogs for separating the setting tool from the cement retainer, the tubing string is slacked-off (lowered) so the latching dogs engage with a release sleeve carried on the retainer mandrel. Once engaged with the release sleeve, the latching dogs are positioned to be pulled upwardly with the operating mandrel when the setting tool is removed from the retainer.

DISCLOSURE OF INVENTION

Generally, the present invention contemplates a new and improved cement retainer and setting tool assembly uniquely constructed to achieve a number of important operational advantages not found in any one prior assembly. More specifically, the present invention resides in the novel construction of the exemplary assembly to enable the cement retainer to be quickly run into the well, set and sealed, tested for leaks and further sealed, if necessary, quickly and easily disconnected from the setting tool and, after spotting cement, reconnected in a manner allowing for a single-action, straight-pull release of the setting tool, all while assuredly opening and closing the retainer valve at the appropriate times. Advantageously, the foregoing is achieved in an assembly which is of a substantially simpler and more reliable construction than any one prior cement retainer and setting tool assembly.

One important feature of the present invention resides in the construction of the connection between the setting tool mandrel and the cement retainer mandrel. Herein, this connection includes a tubular connector threadably secured at one end thereof to the cement retainer mandrel and slidably, yet non-rotatably, connected to the setting tool mandrel at the other end thereof. Additionally, a releasable locking mechanism in the connection positively secures the connector against such sliding movement and the locking mechanism may be released only after manipulating the setting tool to set the slips carried by the retainer. With this construction, the setting tool mandrel and the retainer mandrel are held against relative movement when running the assembly into a well so as to keep from inadvertently setting the slips at some location in the well other than the desired position for the retainer. Also, with an actuator for the retainer valve connected directly with the setting tool mandrel and a housing for the valve on the retainer, the valve is held positively open so that well fluids may flow easily through the retainer and into the tubing string as the assembly is run into the well.

Herein, the slidable connection of the connector to the setting tool mandrel is provided by a tubular housing which is telescoped with the connector. The upper end of the housing is secured to the setting-tool mandrel and elongated slots in diametrical sides of the housing slidably receive projections from the connector so torque can be transmitted from the setting tool mandrel, through the connector housing and to the connector for turning the connector loose from the retainer mandrel after setting the slips. For setting the slips, the connector housing is provided with a generally upwardly facing shoulder which abuts with a generally downwardly facing shoulder on the connector. This enables lifting force to be transmitted from the setting-tool mandrel, through the connector and to the retainer mandrel. The valve actuator is carried upwardly with the setting tool mandrel as the latter is lifted to set the slips so that coincident therewith the valve is closed. With the valve closed, the tubing string may be pressure tested for leaks. Thereafter, the valve may be reopened by lowering the setting tool for pressure testing the annulus and if found to leak, additional lifting of the setting tool may further set the packing between the slips to stop the leak. Subsequent rotation of the setting-tool mandrel in an appropriate direction will disconnect the connector from the retainer mandrel, allowing the setting tool to be lifted to a position above the retainer for spotting cement in the well.

Advantageously, the lower end of the connector housing aligns vertically with the upper end of the retainer mandrel and the length of each of the connector housing slots is greater than the distance the valve is moved between its open and closed positions so the connector projections avoid engaging either of the ends of the slots during movement of the connector within the connector housing. By virtue of this construction, when the setting tool mandrel is reinserted into the cement retainer after spotting for squeezing cement through the retainer, the connector is free to slide upwardly with the connector housing without having to make up the threads between the connector and the retainer mandrel in order to open the valve for cement to flow from the setting tool. This enables the setting tool to be removed from the cement retainer in a single action by simply pulling up on the tubing string to which the setting tool is attached so that, if needed, the setting tool can be removed very quickly from the cement retainer.

Another feature of the present invention resides in the novel construction of the releasable locking mechanism whereby such mechanism is released as an incident to initially setting the upper slips of the cement retainer. In particular, the locking mechanism comprises a collet telescoped over the connector housing with spring fingers of the collet normally extending through openings in the housing and seated within an annular groove in the top of the connector. In the setting tool, a slip follower includes a lower end portion which prior to setting the slips surrounds the collet and locks the fingers against movement out of the connector groove. With this construction, the connector projections are located in an intermediate position relative to opposite ends of the housing slots and the connector is supported against movement relative to either the setting-tool mandrel or the retainer mandrel when running the retainer and setting tool assembly into the well.

Additionally, invention resides in the novel manner of shifting a slip-retaining sleeve from a run-in position into a slip-setting position. In the run-in position, the retaining sleeve encloses portions of the upper ends of the upper slips to keep these slips locked on the retainer as the tubing string is being lowered into the well. In the slip-setting position, the sleeve is retracted upwardly from the upper slips, allowing the latter to be shifted against a setting head on the retainer and wedged outwardly against the interior wall of the casing.

Specifically, an important structural feature of the setting tool contemplates the use of a radially resilient setting tool carrier for moving the sleeve from its run-in position so as to avoid jamming within the setting tool so that the sleeve may be shifted reliably into its slip-setting position when the setting-tool mandrel is rotated.

The foregoing and other important features and advantages of the present invention will become more apparent from the following description of the best mode of carrying out the invention when taken in conjunction with the accompanying drawings.

BRIEF DESCRIPTION OF DRAWINGS

FIG. 1 is an illustration representing a collage of sheets 1 through 12 assembled together in a manner to show more readily relative movement of parts of a cement retainer and setting tool assembly embodying the novel features of the present invention.

FIGS. 2*a* and 2*b* represent a combined elevational and cross-sectional view of the setting tool portion of the exemplary cement retainer and setting tool assembly.

FIGS. 3*a* through 3*c* represent a combined elevational and cross-sectional view of the cement retainer and setting tool assembly of the present invention as prepared for installation in a well.

FIGS. 10*a* through 10*c* represent a combined elevational and cross-sectional view similar to the one shown in FIGS. 9*a* through 9*c* but with parts of the assembly shown in a subsequent, sequentially moved position as normally occuring in service use.

FIGS. 11, 12 and 13 are enlarged, cross-sectional views taken along lines 11—11, 12—12 and 13—13, respectively, of FIG. 2.

BEST MODE OF CARRYING OUT THE INVENTION

Figure 8A:
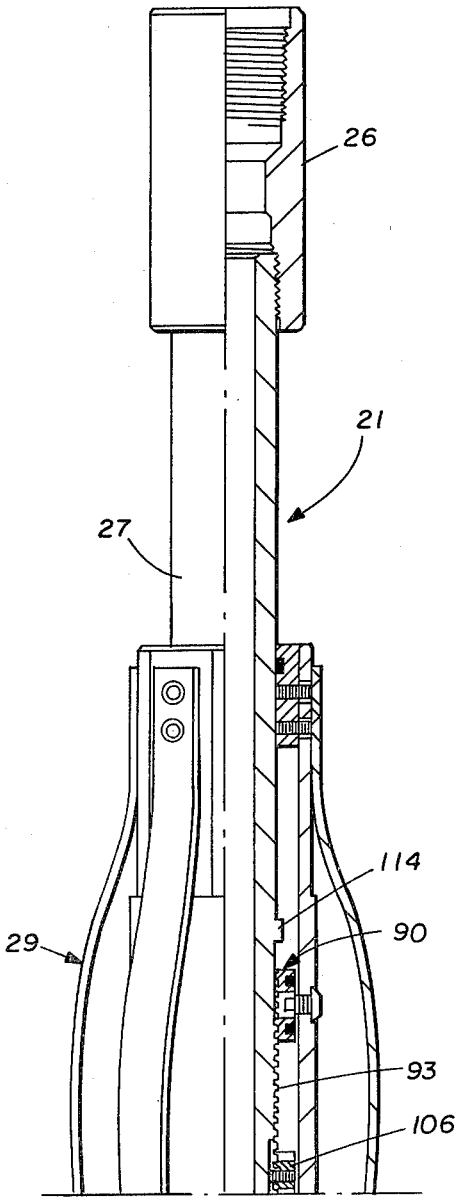
FIGS. 8*a* through 8*c* represent a combined elevational and cross-sectional view similar to the one shown in FIGS. 7*a* through 7*c* but with parts of the assembly shown in a subsequent, sequentially moved position as normally occuring in service use.
Figure 9A:
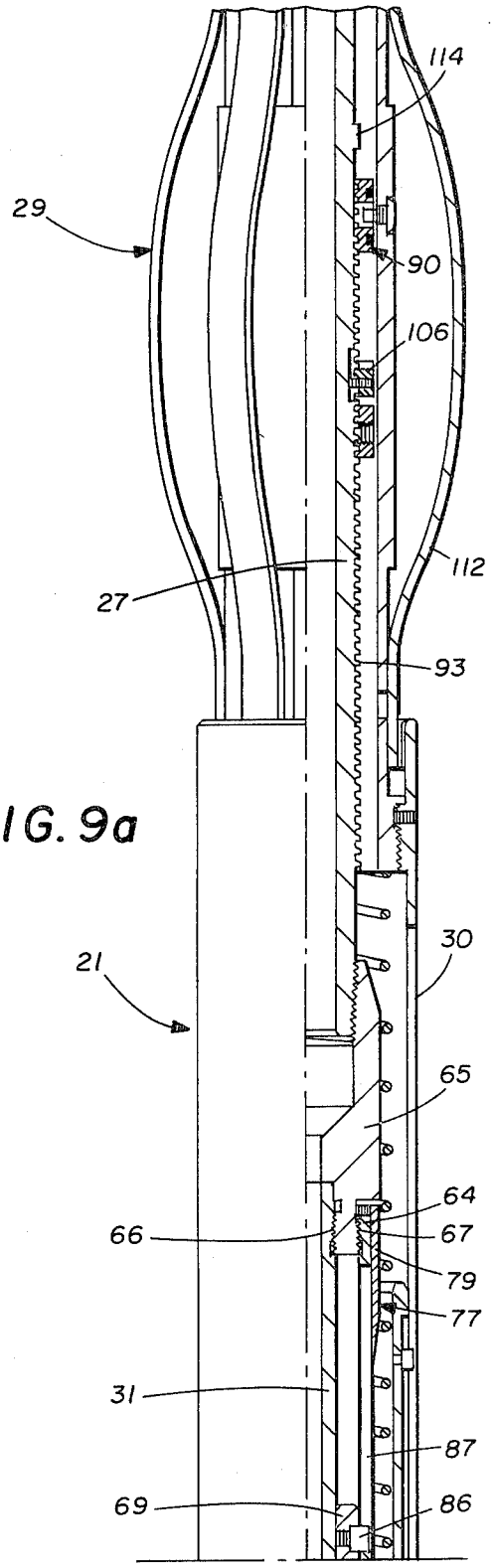
FIGS. 9*a* through 9*c* represent a combined elevational and cross-sectional view similar to the one shown in FIGS. 8*a* through 8*c* but with parts of the assembly shown in a subsequent sequentially moved position as normally occuring in service use.
Figure 8B:
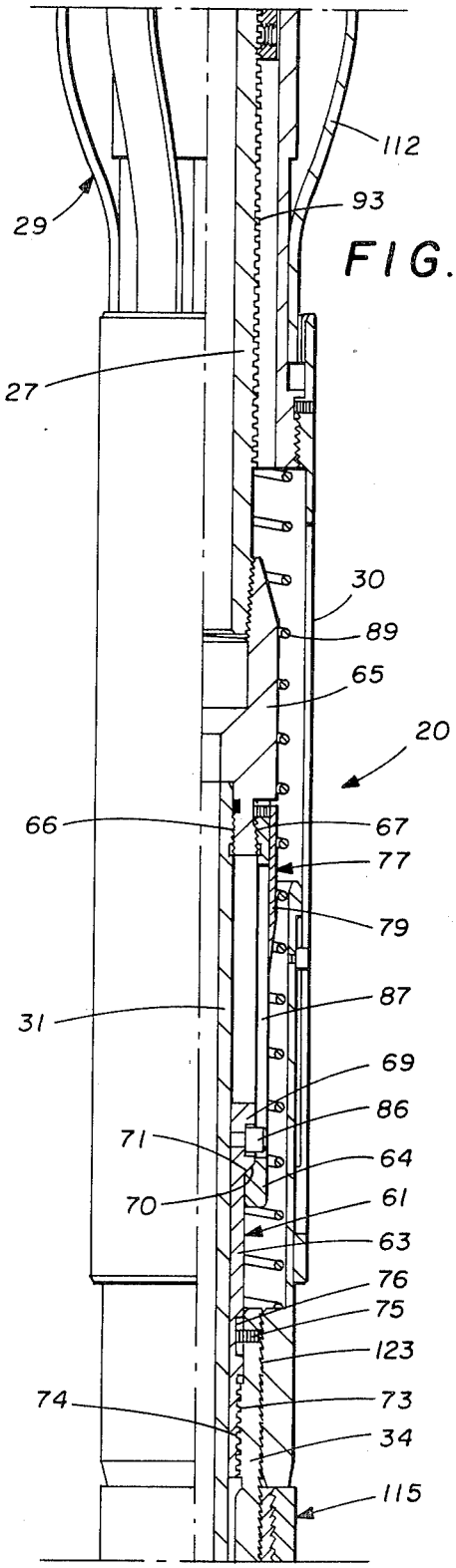
Figure 9B:
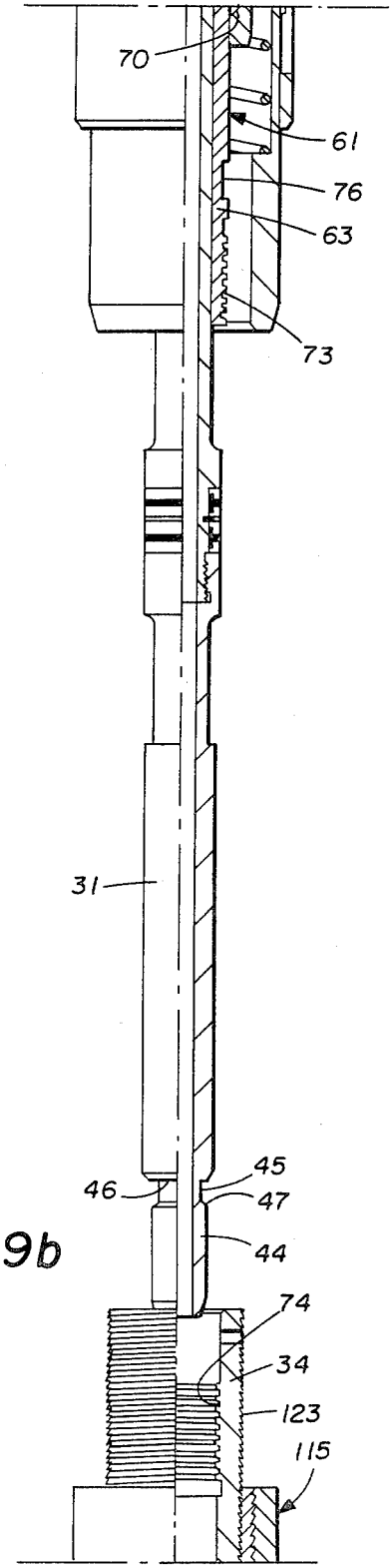
Figure 8C:
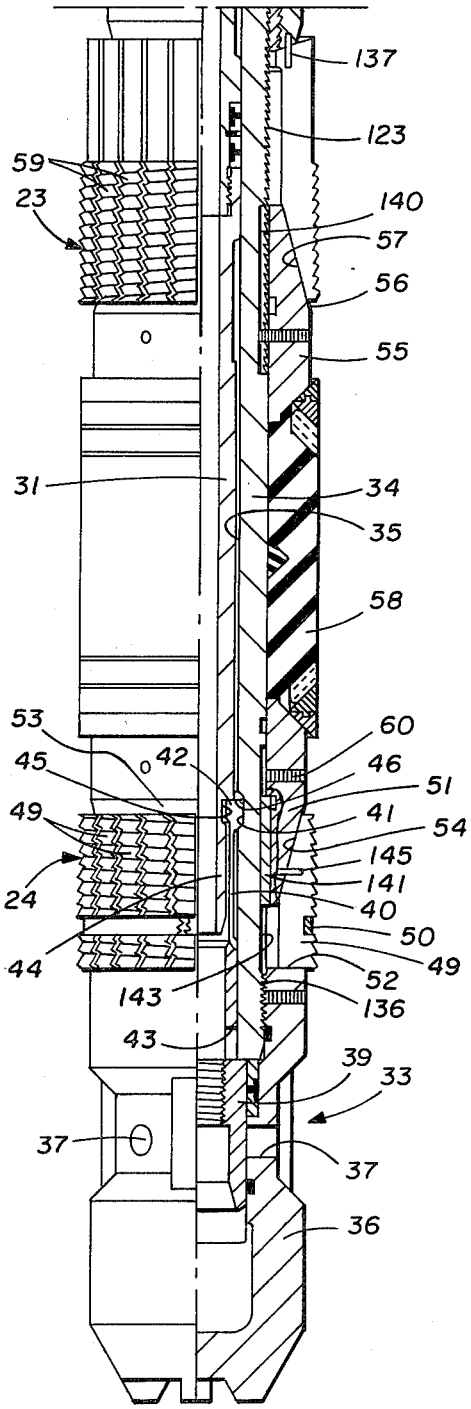
Figure 9C:
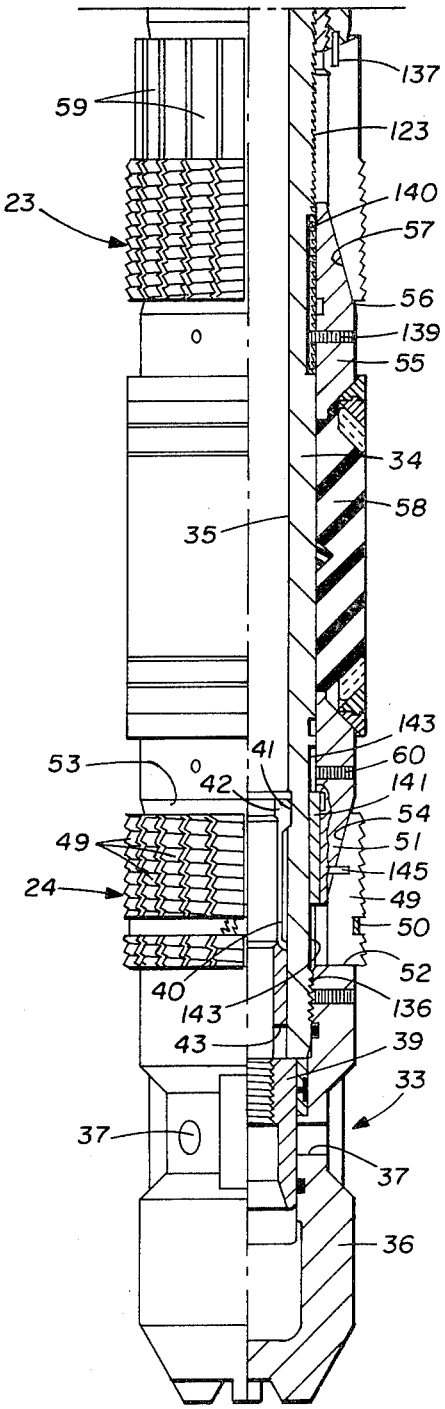
Figure 10B:
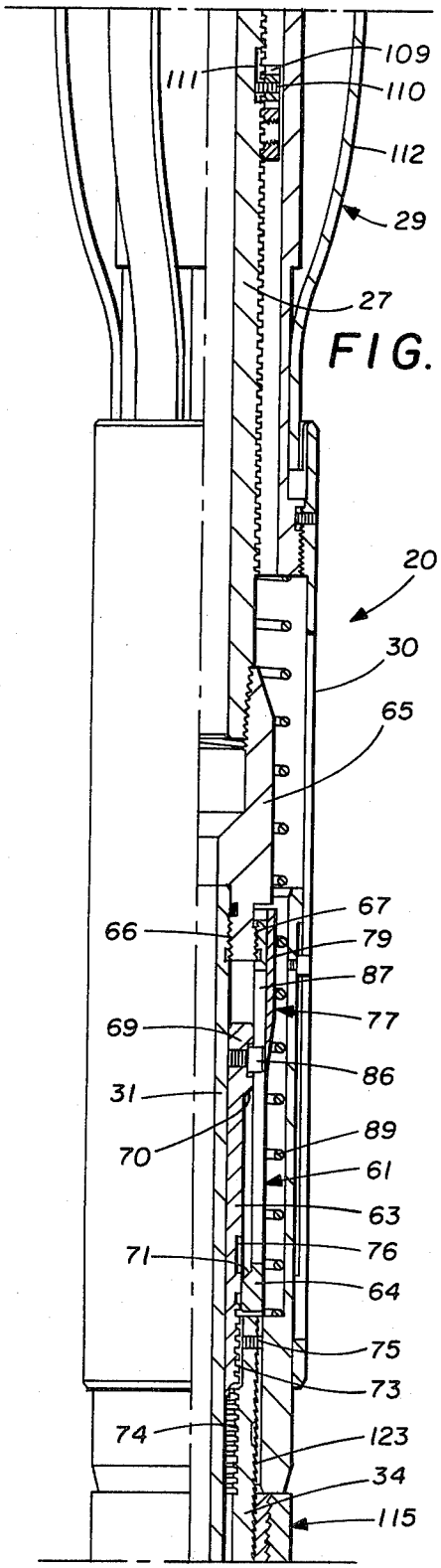
Figure 10C:
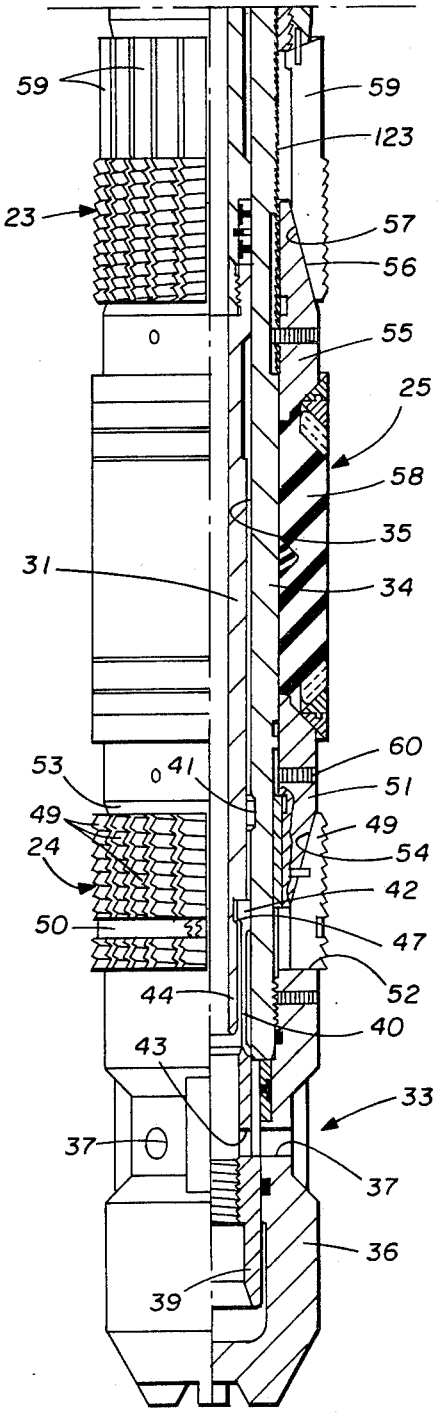

As shown in the drawings for purposes of illustration, the present invention is embodied in a drillable cement retainer and setting tool assembly 20, particularly suited for use in an oil or gas well in cementing a section of the casing in the well to plug leaks or perforations. In service use, the assembly 20 is run in the well on the lower end of a tubing string (not shown) into a position immediately above the section of the casing which is to be cemented. Once in position, (FIGS. 3*a*–3*c*), the tubing string is manipulated to actuate a setting tool 21 in the assembly 20 to deploy upper and lower slip sets 23 and 24 in a cement retainer 25 connected to the setting tool and thereby cause the cement retainer to be anchored (FIGS. 5*a*–5*c* and 8*a*–8*c*), to the inside of the well casing (not shown). After the cement retainer is anchored in place, the tubing string and the annulus defined between the tubing string and the well casing may be tested (FIGS. 8*a*–8*c*) separately for leaks. Thereafter, separation of the setting tool 21 from the cement retainer 25 (FIGS. 9*a*–9*c*) allows cement to be spotted in the well immediately above the cement retainer and the setting tool may be recoupled (FIGS. 10*a*–10*c*) with the cement retainer for squeezing cement into the section of the well beneath the cement retainer. After cementing the setting tool is removed from the cement retainer as the tubing string is pulled from the well to allow the cement to harden before drilling out the cement retainer and the section of the well which is being sealed.

Figure 2B:
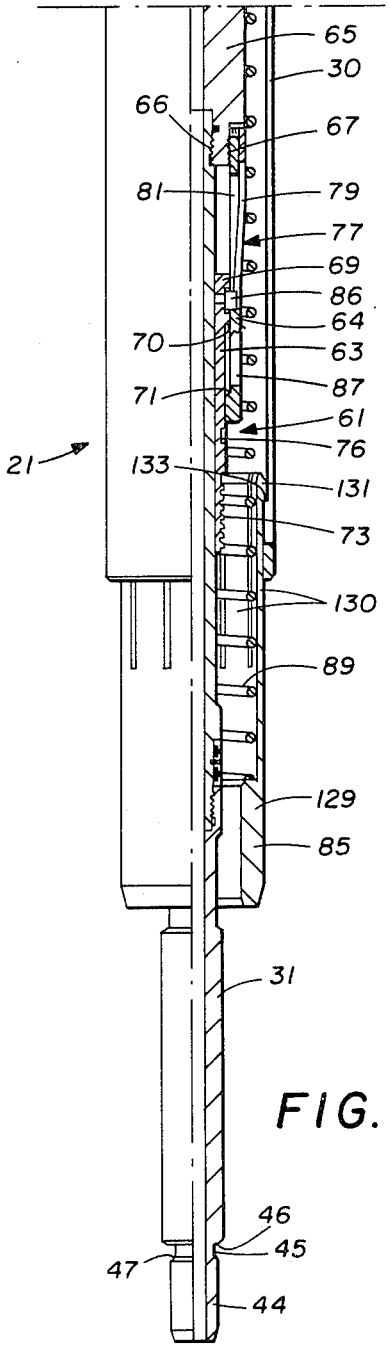
Figure 4:
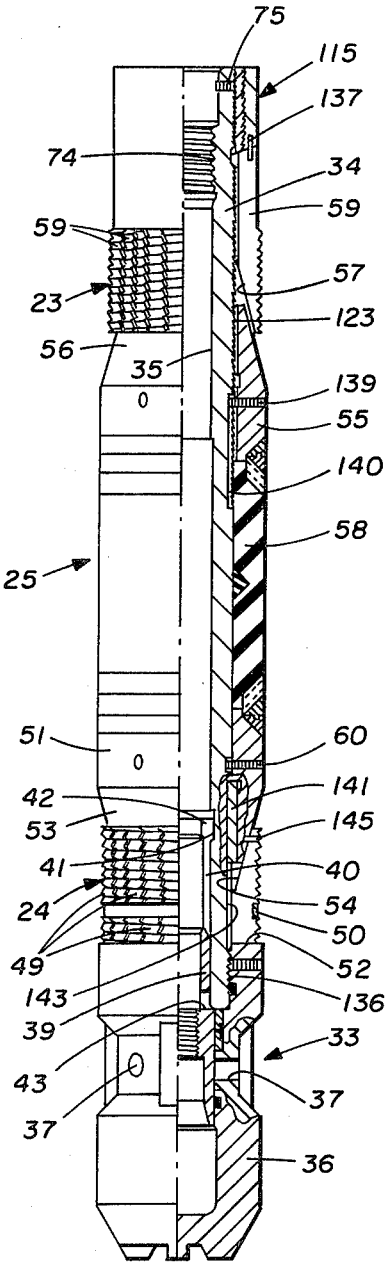
FIG. 4 is a combined elevational and cross-sectional view of the cement retainer portion of the exemplary cement retainer and setting tool assembly.

Herein, the setting tool 21 and the cement retainer 25 of the assembly 20 are shown separately in FIGS. 2*a* and 2*b*, and FIG. 4, respectively. Generally, the setting tool 21 includes an upper coupling 26 threaded on the upper end of a setting-tool mandrel 27 for connecting the setting tool to the lower end of the tubing string. The setting-tool mandrel 27 is telescoped through a drag mechanism 29 which carries a retaining sleeve 30 attached to the lower end thereof. The retaining sleeve is sized to telescope over the upper end portion of the upper slip set 23 in the cement retainer 25 when the setting tool is coupled with the cement retainer to keep the upper slip set from deploying as the assembly 20 is lowered into the well. Also connected to the setting-tool mandrel 27 is a tubular actuator 31 sized to telescope into the cement retainer to connect with a value 33 at the lower end of the cement retainer for opening and closing the valve at various times during the installation and use of the cement retainer in the well.

As shown in FIG. 4, the cement retainer includes an elongated tubular mandrel 34 having a central passage 35. The cementing valve 33 is connected to and suitably sealed with the lower end portion of the retainer mandrel 34 and includes a housing 36. A plurality of angularly spaced ports 37 open radially from the sides of the housing and a generally cylindrical valve member 39 is disposed within the valve housing for movement between open and closed positions relative to the valve ports 37. As shown in FIG. 4, the valve member 39 is in an upper position within the housing 36 to close the valve ports 37 and is supported in this upper position by means of outwardly biased spring fingers 40. Enlarged upper end portions 42 of these fingers seat within an annular groove 41 formed within the lower end portion of the retainer mandrel 34.

Figure 3B:
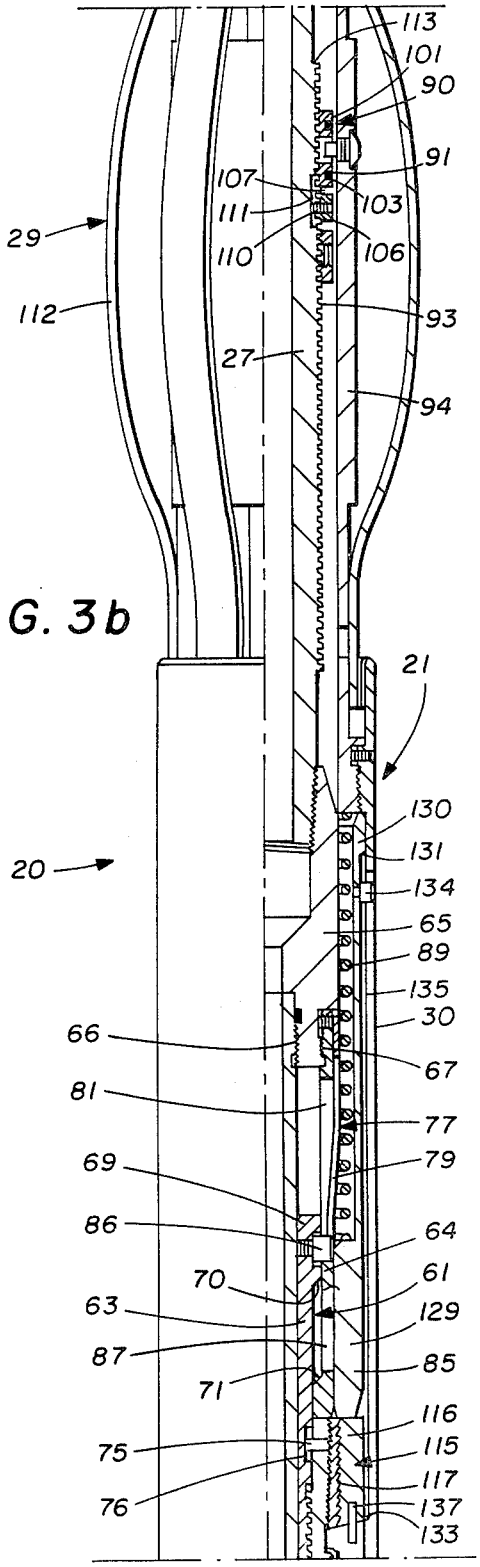
Figure 3C:
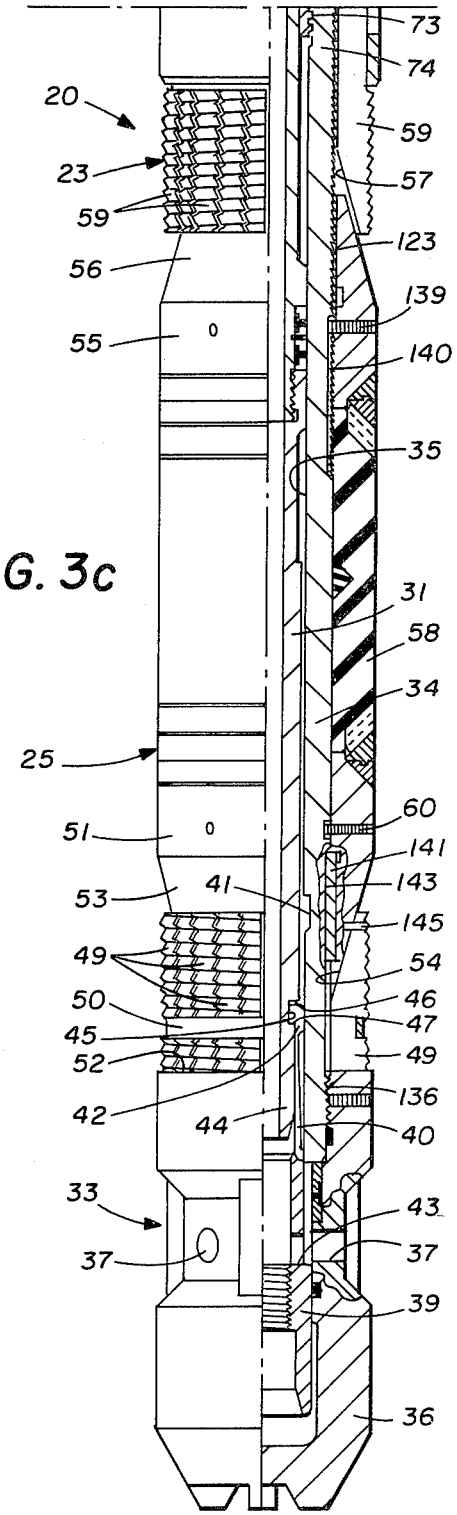

When the setting tool 21 is assembled with the cement retainer 25 for running into the well, the valve actuator 31 engages the spring fingers 40 of the valve member 39 to shift the valve into a lower position within the housing 36 so that radial openings 43 within the valve member 39 are in registry with the valve ports (see FIG. 3*c*). For shifting the valve member 39 from its upper position into its lower open position, the actuator 31 includes a reduced diameter lower end section 44 whose upper end is formed with a channel 45 to define a socket for receiving the enlarged upper ends 42 of the spring fingers 40. The upper side of the channel 45 defines a shoulder 46 which when lowered against the upper end of the spring fingers 40 urges the valve member downwardly with the fingers flexing inwardly into the space provided between the interior surface of the retainer mandrel and the exterior surface of the reduced diameter section 44 of the actuator 31. In lifting the valve member 39 into its upper or closed position, a lower shoulder 47 defined by the channel 45 engages the undersides of the enlarged ends 42 of the spring fingers 40 to pull the valve member upwardly as the actuator is pulled upwardly. Because the spring fingers are confined against flexing radially outward by the interior surface of the retainer mandrel, the actuator cannot be pulled freely upward within the retainer mandrel without also moving the valve member 39 into its closed positon. In moving upwardly within the housing 36, however, once the enlarged upper ends 42 of the spring fingers 40 register with the annular groove 41 in the retainer mandrel, the fingers flex radially outward, thereby disconnecting from the actuator so that the actuator is then free to move further upwardly within the retainer mandrel 34 without carrying the valve member further upwardly within the housing.

As further shown in FIG. 4, the lower slip set 24 in the cement retainer 25 comprises a plurality of angularly spaced slip segments 49 held together around the lower end portion of the retainer mandrel 34 by means of a frangible retaining band 50. Preferably, the slip segments are supported upwardly on the retainer mandrel by a shoulder 52 defined by upper end of the valve housing 36. Surrounding the retainer mandrel immediately above the lower slip set 24 is a lower expander head 51 having an inverted frusto-conical exterior surface 53 which mates with upwardly and outwardly slanting interior surfaces 54 of the various slip segments. In use, when the retainer mandrel is lifted upwardly relative to the lower expander head, the valve housing 36 pushes the slip segments upwardly over the expander head surface 53, wedging the segments radially outwardly into engagement with the interior wall of the well casing, causing the frangible band to break and anchoring the segments in the interior wall of the well casing.

Surrounding the retainer mandrel 34 immediately above the expander head 51 is an elastomeric packing sleeve 58 and above the packing sleeve 58 is an upper expander head 55. The latter includes a frusto-conical surface 56 positioned for engagement with downwardly and outwardly slanted surfaces 57 of segments 59 of the upper slip set 23 to wedge the upper segments outwardly when anchoring the cement retainer in the well. In setting the lower and upper slip segments 49 and 59 in the well casing, the upper slip set 23 is anchored first in the casing and the lower slip set 24 is pulled upwardly with the retainer mandrel 34 causing the lower expander head 51 to compress the elastomeric packing sleeve 58 and cause the sleeve to thereby expand radially outward to seal against the interior wall of the well casing.

Advantageously, to avoid premature compacting of the elastomeric sleeve 58 while running the assembly 20 into the well, a frangible pin 60 (see FIG. 3*c*) is connected between the lower expander head 51 and the retainer mandrel 34. With this construction, should the lower expander head 51 or the lower slip set 24 hit something as it is lowered into the well, the impact will be absorbed through the pin 60 and transmitted to the mandrel rather than through the packing. Otherwise, the packing could be compressed and rub against the interior wall of the casing as the assembly is being lowered. The loss of packing due to rubbing against the sides of the casing can keep the seal between the retainer and the casing from being made properly when anchoring the retainer in the well.

In accordance with one of the more important features of the present invention, a unique connection 61 is provided between the setting-tool mandrel 27 and the retainer mandrel 34 to permit the testing of the tubing string and the annulus for leakage after setting the upper and lower slip sets 23 and 24 without also disconnecting from the retainer mandrel 34 so that the elastomeric sleeve 58 may be compacted further if necessary in order to effect a proper seal between the cement retainer 25 and the interior wall of the casing. For these purposes, the connection includes a connector 63 which is slidably but non-rotatably connected to the setting-tool mandrel 27 and is threadably connected with the retainer mandrel 34. The sliding movement between the setting-tool mandrel and the connector allows the valve 33 to be opened and closed without transmitting slip-setting force from the setting-tool mandrel to the retainer mandrel. With the valve closed after anchoring the retainer in the well, the tubing string may be pressure tested for leaks and with the valve reopened, the annulus may be pressure tested. Thereafter, by rotating the tubing string in a right-hand direction (clockwise at the well head), the setting-tool mandrel may be disconnected from the retainer mandrel for spotting cement in the well. By virtue of the relative sliding movement between the connector and the setting-tool mandrel, when reinserting the valve actuator 31 in the retainer mandrel 34, the connector is kept from being threaded with the retainer mandrel yet the actuator may be lowered into the retainer mandrel sufficiently to open the valve for passing cement. Additionally, the connection 61 includes a releasable locking mechanism 77 which normally secures the connector 63 against sliding relative to the setting-tool mandrel in order to keep the valve 33 open as the assembly 20 is being lowered into the well.

Figure 6:
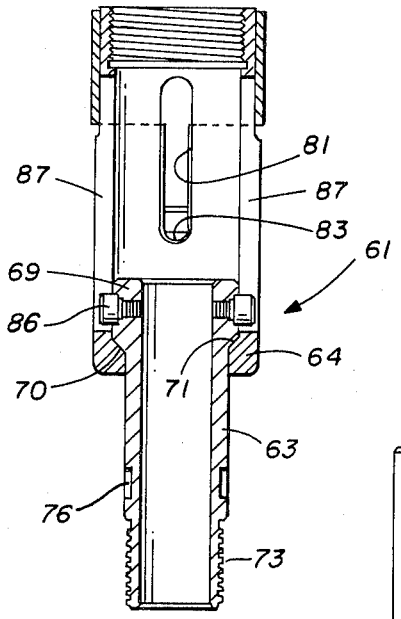
FIG. 6 is an enlarged cross-sectional view generally similar to the view shown in FIG. 17 as if seen from a right angle thereto with some parts removed for clarity and others shown in moved positions.
Figure 5A:
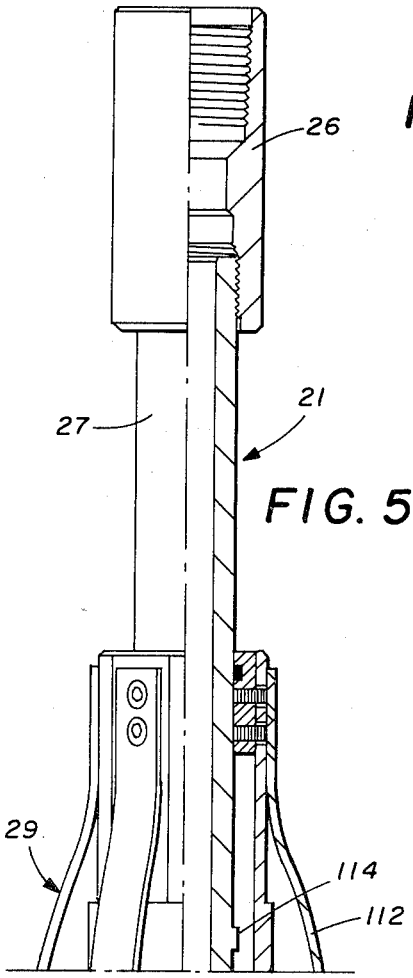
FIGS. 5*a* through 5*c* represent a combined elevational and cross-sectional view similar to the one shown in FIGS. 3*a* through 3*c* but with parts of the assembly shown in a sequentially moved position as normally occuring in service use.

In the present instance the connection 61 (see FIGS. 3*b*, 3*c* and 17) includes a connector housing 64 threaded onto the lower end of the setting-tool mandrel 27 by means of a tubular adapter 65. The upper end of the adapter 65 is threadably secured to the lower end of the setting-tool mandrel and includes both internal and external threaded sections 66 and 67 which are mated with corresponding threaded sections on the upper end of the valve actuator 31 and the upper end of the connector housing 64, respectively. The connector housing is concentric with the valve actuator but is spaced radially outward from the actuator and telescoped into the space between the connector housing and the actuator is the connector 63. Herein, the connector includes an enlarged diameter upper end portion 69 which defines an annular shoulder 70 that slants upwardly upon projecting radially outward. A mating annular shoulder 71 is formed within the connector housing 64 to slant downwardly upon progressing radially inward from the inner surface of the housing. When the setting tool 21 and the retainer 25 are assembled together for being run into the well, the vertical distance between the shoulders 70 and 71 as shown in FIGS. 3*b* and 3*c* is substantially equal to the distance which the valve member 39 must be moved by the actuator 31 in order to close the valve ports 37. Once the valve is closed, slip setting force may be transmitted from the setting-tool mandrel 27 to the retainer mandrel 34 through the two abutting shoulders 70 and 71 as are shown in FIG. 6.

Integrally formed with the lower end portion of the connector 63 is an externally threaded section 73 which, herein, is left-hand threaded to mate with an internally threaded section 74 in the retainer mandrel 34. To keep the connector secured to the retainer mandrel 34 during lowering of the retainer 25 into the well, a frangible pin 75 extends radially inwardly from the retainer mandrel 34 into a longitudinal slot 76 formed in the exterior surface of the connector 63. The pin 75 prevents relative rotation between the connector and the retainer mandrel as long as the magnitude of the right-hand torque applied across the threaded section 73 and 74 is less than some predetermined magnitude which is sufficient to shear the pin 75.

In order to transmit torque through the connection 61, the enlarged upper end portion of the connector 69 includes diametrical outwardly extending projections 86 in the form of cylindrically headed screws which fit within elongated slots 87 formed in the connector housing 64. Herein, the elongated slots 87 extend between opposite ends of the connector housing with the upper and lower ends of the elongated slots being spaced from such opposite ends of the housing. With this construction, when the tubing string is rotated in a right-hand direction, torque may be transmitted through the adapter 65, the connector housing 64 to the projections 86 and to the connector 69. With the upper slip set 23 anchored within the well casing, right-hand torque is transmitted from the connector to the retainer mandrel 34 through the frangible pin 75. If the torque exceeds the strength of the pin 75 the pin shears and the connector is screwed loose from the retainer mandrel 34.

Figure 17:
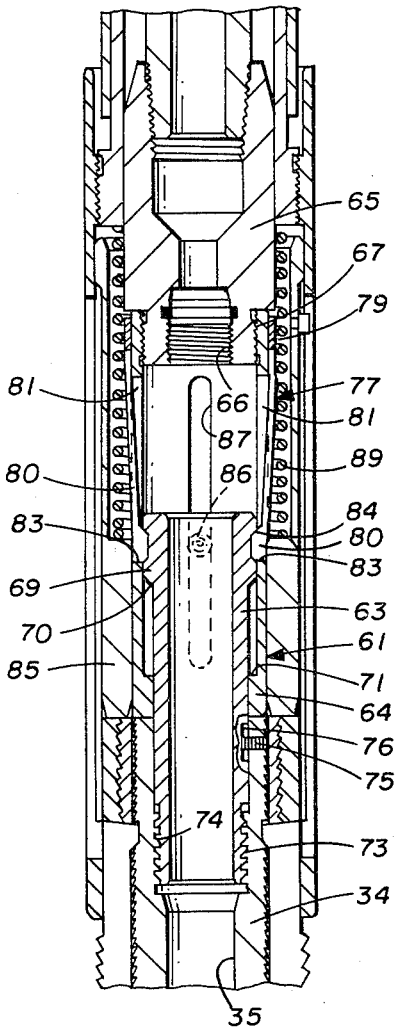
FIG. 17 is an enlarged, cross-sectional view of a portion of the exemplary assembly taken generally at a right angle relative to the assembly in comparison to the view shown in FIG. 5*b*.

To keep the connector from sliding within the housing and possibly closing the valve 33 during run in, the releasable locking mechanism 77 interfits with the connector 63 through the connector housing 64 and locks the connector within the housing with the shoulders 70 and 71 spaced vertically from each other. Specifically, the releasable locking mechanism comprises a locking collet 79 having diametrical spring fingers 80. The collet is telescoped over the connector housing 64 with the spring fingers 80 resiliently biased radially inward through shorter longitudinal slots 81 formed diametrically of each other through the connector housing 64. Herein, the slots 81 extend in a longitudinal direction within substantially the upper half of the connector housing so that lower ends 83 of each of the slots 81 are located approximately midway between opposite ends of the connector housing 64 as is shown in FIGS. 6 and 17. Enlarged tips of the spring fingers 80 of collet 79 both rest against the lower ends of the slots 83 and fit within an annular groove 84 (FIG. 17) formed within the enlarged upper end portion 69 of the connector. Advantageously, a slip follower 85 engages the radially outward side of the spring fingers 80 when the connector is in its running-in position to lock the spring fingers in place and thereby support the connector 63 against movement within the connector housing 64. As shown in FIG. 3*b*, the slip follower 85 is located within the retaining sleeve 30 and is urged downwardly by a coil spring 89 sandwiched between the follower 85 and the retaining sleeve 30 to cause the upper slip set to deploy when the retaining sleeve is retracted.

More particularly, the follower 85 includes an enlarged lower end portion 129 with a plurality of integrally formed collet fingers 130 (see FIG. 2*b*) extending upwardly therefrom into the retaining sleeve 30. Outwardly projecting shoulders 131 at the upper ends of the collet fingers 130 are sized to abut a corresponding inwardly projecting shoulder 133 formed at the lower end of the retaining sleeve 130 to limit downward movement of the follower within the retaining sleeve. The follower also is locked against rotational movement relative to the retaining sleeve by means of a screw 134, (see FIG. 3*b*) which includes an enlarged head projecting radially outward from diametrically opposed collet fingers 130 to fit within elongated slots 135 formed in opposite sides of the retaining sleeve 30. The coil spring 89 is captivated within the follower with the lower end of the spring abutting the upper end of the enlarged lower portion of the follower and the upper end of the spring abuts the lower end of the anchor cage 94.

In accordance with the other important feature of the present invention, the setting tool 21 includes a unique carrier 90 connected between the drag mechanism 29 and the setting-tool mandrel 27 so as to positively retract the retaining sleeve 30 from the upper slip set 23 when the setting-tool mandrel 27 is rotated while reducing the likelihood that debris within the drag mechanism may cause parts of the mechanism to jam and thereby keep the retaining sleeve from being retracted fully and the upper slip set from deploying. For these purposes, the carrier includes radially resilient means in the form of lugs 91 which interfit with a spiral guide surface such as a threaded section 93 on the setting-tool mandrel so that, when the setting-tool mandrel 27 is rotated, the lugs ride on the guide surface to move the drag mechanism and, in turn, the retaining sleeve 30 vertically on the setting-tool mandrel. By virtue of the radial resiliency of the lugs in connecting with the spiral guide surface, any debris collecting on the spiral guide surface and tending to cause the lugs to jam can be ridden over without the potential jam occurring.

As shown more particularly in FIGS. 10*a* and 12, three of the lugs 91 define the carrier 90 as a segmented nut located between the retainer mandrel 27 and a tubular anchor cage 94 of the drag mechanism 29. The anchor cage 94 is telescoped over the setting-tool mandrel 27 and is connected to each of the lugs or nut segments 91 by means of three screws 95. The latter are secured to the anchor cage 94 at angularly spaced positions and include inner end portions 96 projecting radially inward from the anchor cage to be slidably received within openings 97 in the lugs. The lugs are substantially identical to each other, being arcuate in shape with generally smooth exterior surfaces 99 and inner surfaces 100 suitably grooved to define threaded sections to mate with the threaded section 93 of the retainer mandrel 27. The openings 97 of the lugs are arcuately centered and extend in a generally radial direction through each lug. Above and below the openings within the exterior surface 99 of each lug are formed grooves 101 and 103 (see FIG. 10*a*) extending in a generally lateral direction. Upper and lower garter springs 104 and 105 are seated within the upper and lower grooves 10 and 103 so that the threaded inner surfaces 100 of the lugs 91 are resiliently biased against the threaded section 93 of the setting-tool mandrel 27.

Advantageously, a stop ring 106 is secured to the setting-tool mandrel 27 for engagement with one of the lugs 91 in order to position the drag mechanism 29 and thus the retaining sleeve 30 vertically on the setting-tool mandrel. Accordingly, when the setting tool is assembled with the cement retainer 25, the lower end portion of the retaining sleeve 30 telescopes to a limited extent over an upper portion of each of the segments 59 of the upper slip set 23. Herein, one of the lugs 91 includes a downwardly extending projection 107 (see FIG. 3*b*) and the stop ring 106 includes a similar projection 109 (see FIG. 5*b*) extending upardly therefrom. With this arrangement, when assembling the setting tool 21 and the cement retainer 25, the stop ring 106 is positioned so that the two projections 107 and 109 abut each other in a circumferential direction to limit relative rotation between the setting-tool mandrel 27 and the anchor cage 94 in a left-hand direction so that the cage is kept from moving downwardly relative to the mandrel 27 to possibly cause binding between the parts of the setting tool and the cement retainer. Preferably, the stop ring 106 includes smooth interior and exterior surfaces and is secured to the setting-tool mandrel 27 by means of a set screw 110 which seats within a suitable recess 111 in the exterior surface of the setting-tool mandrel. Advantageously, the length of the recess 111 is elongated axially relative to the setting-tool mandrel to provide for vertical adjustment in the positioning of the stop ring 106.

When the setting-tool mandrel 27 is rotated after the assembly 20 has been lowered into a selected position within the well where the cement retainer 25 is to be anchored, drag springs 112 attached to the exterior of the anchor cage 94 frictionally hold against the interior wall of the casing to keep the anchor cage from rotating with the setting tool mandrel 27. Herein, six drag springs are secured by screws to the outside of the anchor cage 94 at the upper ends of the springs. The lower ends of the springs are free to slide longitudinally on the cage but are captivated against circumferential movement between angularly spaced flanges 108 (see FIG. 13). The latter are integrally formed with and protrude radially outward from the lower end of the cage. With this construction, as the mandrel is rotated in a right-hand direction, the carrier 90 rides on the threaded section 93 upwardly on the setting-tool mandrel 27 to in turn lift the retaining sleeve 30 upwardly off the upward end portion of the slip segments 59. The distance that the retaining sleeve is lifted is determined by the distance between the upper side of the stop ring 106 and an upper end 113 of the threaded section 93. Spaced above the upper end 113 of the threaded section 93 is an annular shoulder 114 which serves to block further upward movement of the carrier 90 relative to the mandrel even though the mandrel may be further rotated. The shoulder 114 also serves to limit expansion of the setting spring 89 upwardly relative to the setting-tool mandrel 27.

Once the lower end portion of the retaining sleeve 30 is moved upwardly of the upper end of each of the slip segments 59, the spring 89 urges the slip follower 85 downwardly, causing the slip segments to slide upon the expander head 55 and move radially outwardly into engagement with the casing. As the slip follower moves downwardly, the inner surface of the lower end portion of the follower is moved downwardly away from the tips of the spring fingers 80 of the locking collet 79 so that the fingers are free to flex radially outward. This frees the connector 63 so that relative sliding movement between the connector 63 and the valve actuator 31 is possible. With the connector free to slide, the setting tool 27 may be lifted by pulling the tubing string upwardly thereby to closing the valve 33 and causing the upper slip set 23 to anchor in the casing. After the upper slip set is deployed and anchored in place, continued upward pulling on the setting-tool mandrel causes the lower slip set 24 to fracture the frangible ring 50 and embed within the interior wall of the casing.

Figure 15:
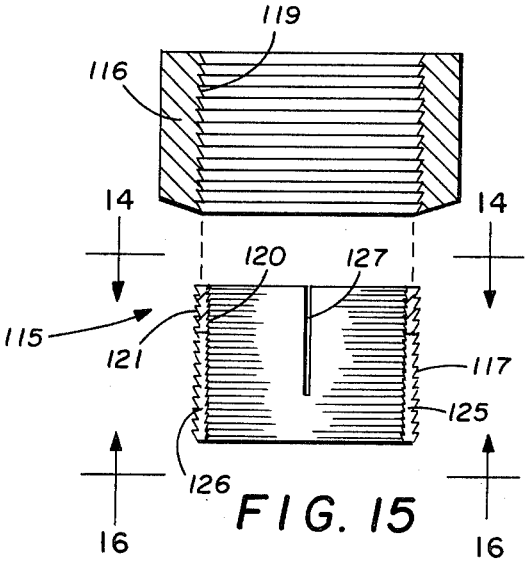
FIG. 15 is an enlarged, exploded, cross-sectional view of two normally interfitting parts of the assembly.

Advantageously, a novel set lock 115 (see FIGS. 7*b*) and 7*c*) is mounted on the cement retainer 25 above the upper slip set 23 for engagement by the follower 85 to secure the upper slip set against sliding upwardly upon the retainer mandrel 34 so as to lock the upper slip set in its anchored position without unduly restricting downward movement of the slip follower under the urging of the spring 89. Herein, the set lock includes a collar 116 telescoped onto the retainer mandrel 34 above the upper slip set 23 and a ratchet ring 117 is disposed within the collar. As shown in FIG. 15, the collar 116 is provided with a one-way interior toothed surface 119 and the ratchet ring includes both external and internally toothed surfaces 120 and 121. The exterior toothed surface of the ratchet ring 117 is provided with substantially larger teeth than the interior toothed surface 120 and the larger teeth 119 and 121 of the collar 116 and ratchet ring 117 are pointed directionly to allow for insertion of the ratched ring downwardly into the collar but to prevent the ratchet ring from sliding upwardly within the collar. The smaller internal teeth 120 of the ratchet ring mate with similarly shaped teeth formed on a section 123 on the outside of an upper end portion of the retainer mandrel 34. The small teeth 120 and 123 of the ratchet ring 117 and retainer mandrel 34 are directionally pointed to prevent relative upward sliding of the ratchet ring on the mandrel 34.

Figure 14:
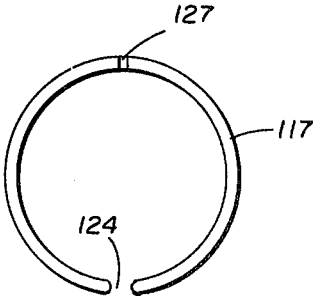
FIGS. 14 and 16 are views taken substantially along lines 14—14 and 16—16 of FIG. 15 and illustrating opposite ends of one of the parts shown in FIG. 15.
Figure 16:
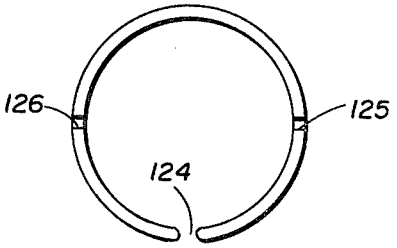

In order to ease sliding of the set lock downwardly on the retainer mandrel 34 under the urging of the spring 89, the ratchet ring is uniquely constructed so that its radial resiliency may be adjusted so that only a small downwardly directed force is required to slide the ring downwardly over the retainer mandrel and still lock the ring against sliding upwardly. Herein, as may be seen in FIGS. 14–16 this is accomplished with the ratchet ring constructed as a split ring including a longitudinal gap 124 and three angularly spaced slits 125, 126, and 127 formed in a longitudinal direction partially through the length of the ratchet ring 117. As shown in FIGS. 15 and 16, the slits 125 and 126 are located diametrically from each other and extend upwardly from the lower end of the ratched ring toward the upper end. The remaining slit 127 extends from the upper end of the retaining ring downwardly and is located diametrically of the gap 124. With this arrangement, when assembling the ratchet ring with the collar 116, the ratchet ring may be bent either radially inwardly or radially outward to adjust for the amount of axially applied force required in order to slip the assembled collar and ring downwardly on the upper end of the retainer mandrel 34. By virtue of this construction, when the retaining sleeve 30 is shifted upwardly to free the upper slip set 23 to be deployed radially outward, most of the force applied by the spring 89 is directed to deploying the various segments 59 of the upper slip sets rather than and overcoming the ratcheting of the slip lock 115.

INDUSTRIAL APPLICABILITY

In service use, the setting tool 21 is connected together with the cement retainer 25 to form the assembly 20 with the actuator 31 telescoped into the retainer mandrel 34 so that the channel shoulder 46 abuts the upper ends of the spring fingers 40 of the valve member 39 to position the valve member downwardly within the housing 36 so that the radial openings 43 are in registry with the valve ports 37. Additionally, the externally threaded section 73 on the lower end of the connector 63 is mated with the corresponding internally threaded section 74 on the retainer mandrel 34 with the lower end of the connector housing 64 abuting the upper end of the retainer mandrel 34 to support the latter against movement upwardly. The frangible pin 60 connected between the lower expander head 51 and the retainer mandrel 34 also supports parts of the assembly against moving relative to each other in the event that the lower expander head 51 or the lower slip set 24 should hit something while being lowered into the well. The ease with which the assembly 20 may be lowered into the well is increased because the valve member 39 is positively supported in an open position for well fluid to flow into and through the assembly as it is being lowered. Advantageously, the valve member 39 is positively secured in its open position owing to the unique construction of the connection 61 between the retainer mandrel 34 and the setting-tool mandrel 27 to positively support the valve member 39 in its open position. Specifically herein, the spring fingers 80 are seated within the annular groove 84 (see FIG. 17) within the enlarged upper end 69 of the connector 63 to support the connector against vertical movement relative to the connector housing 64. The position of the lower end portion 129 of the slip follower 85 keeps the spring fingers 80 of the locking collet 79 from releasing the connector prior to lifting of the retaining sleeve 30 of the drag mechanism 29.

Figure 5C:
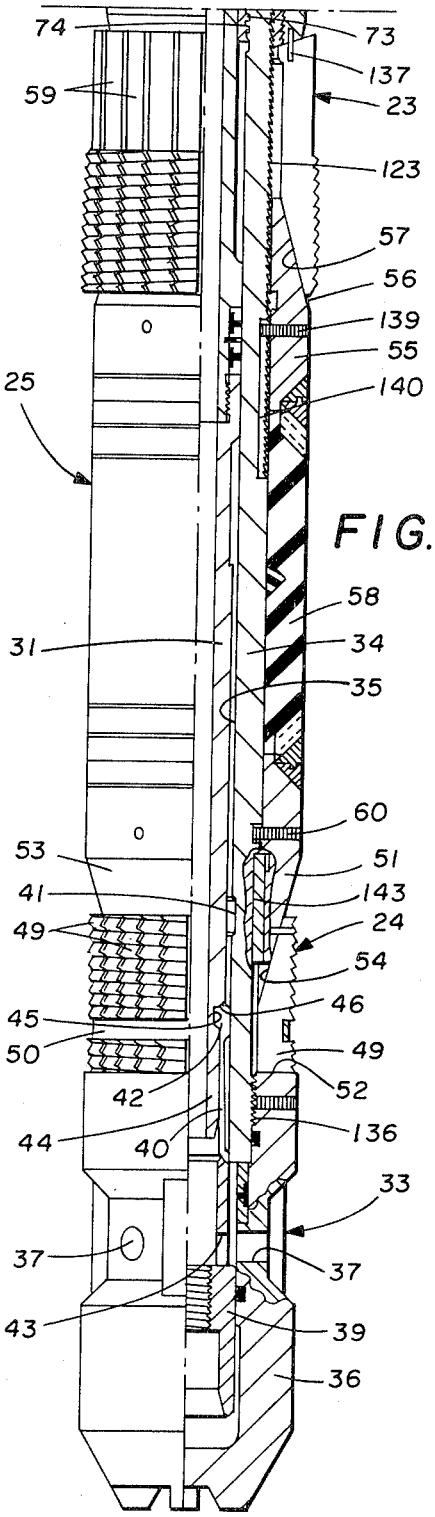

With the assembly 20 connected together in the foregoing fashion, the assembly may be lowered into the well to a position immediately above the section of the well to be cemented. Within the well, the friction springs 112 of the drag mechanism 29 engages the interior wall of the casing to hold the drag mechanism against rotation relative to the casing and thus, when the tubing string is rotated, in a right-hand direction, the setting-tool mandrel 27 also rotates. This causes the carrier 90 to ride upwardly on the threaded section 93 of the setting-tool mandrel to thereby lift both the anchor cage 94 and the retaining sleeve 30 within the casing relative to the retainer 25. As the carrier 90 reaches the upper end 113 of the threaded section 93, the lower end of the retaining sleeve 30 is moved upwardly of the upper ends of the upper slip set 23 to free the segments 59 to slide on the frusto-conical surface 56 of the upper expander head 55. At the same time, the lugs 91 of the carrier 90 are captivated within the space between the upper end 113 of the threaded section 93 and the annular shoulder 114. Once the slip segments 59 are free to slide radially outward, the coil spring 89 urges the slip follower 85 downwardly against the set lock 115 to drive the slip segments 59 radially outward into engagement with the interior wall of the casing. As the follower slides the set lock 115 downwardly over the retainer mandrel 34, the ratchet ring 117 ratches the interior teeth 120 over the exterior ratchet teeth 123 of the mandrel. The upper slip set 23, is thus deployed as is shown in FIG. 5*c*.

Figure 7A:
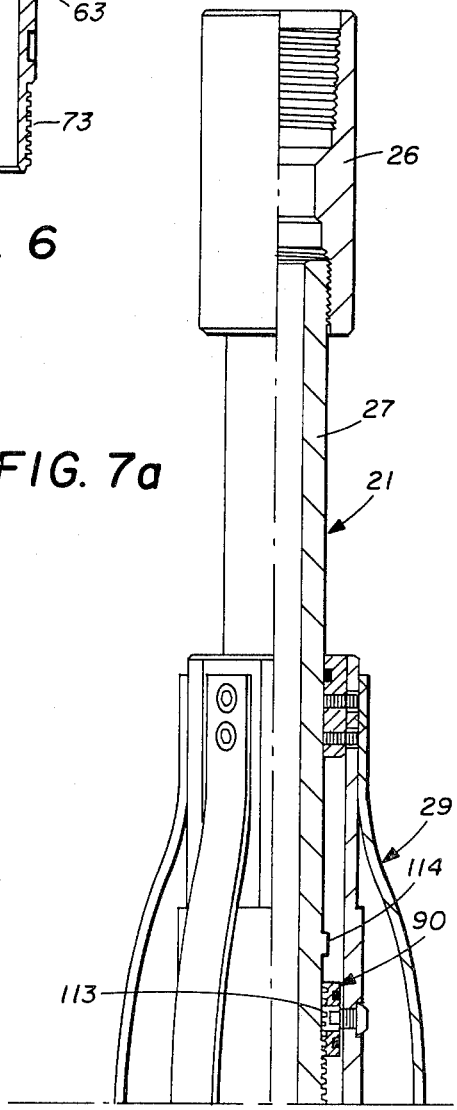
FIGS. 7*a* through 7*c* represent a combined elevational and cross-sectional view similar to the one shown in FIGS. 5*a* through 5*c* but with parts of the assembly shown in a subsequent, sequentially moved position as normally occurring in service use.
Figure 5B:
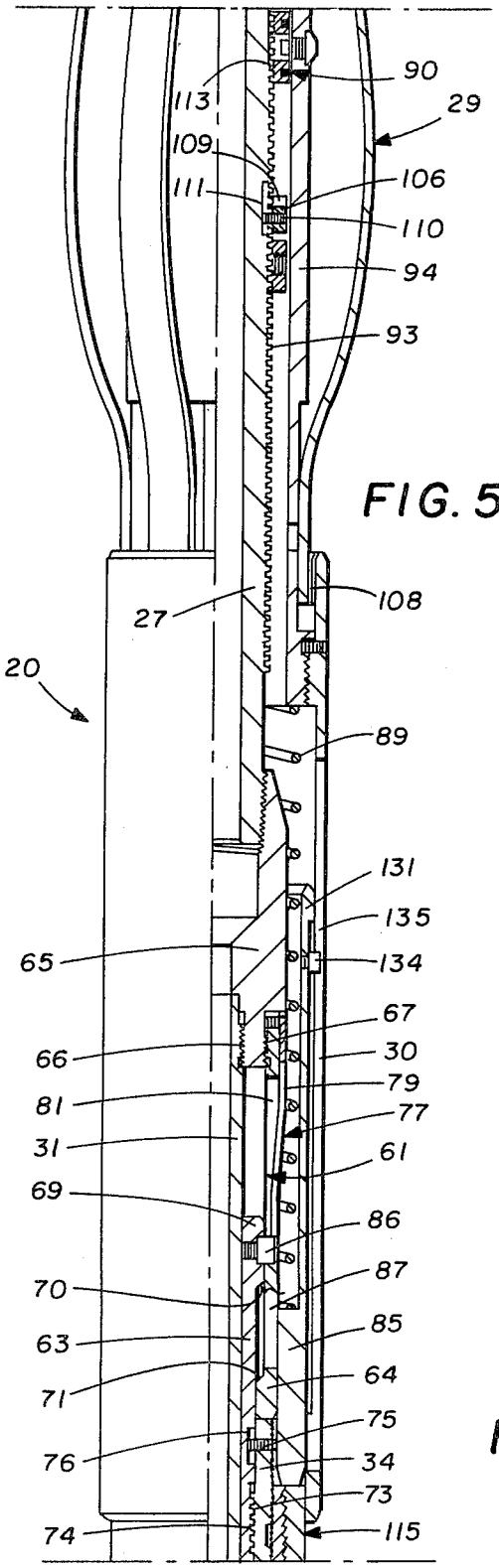
Figure 7B:
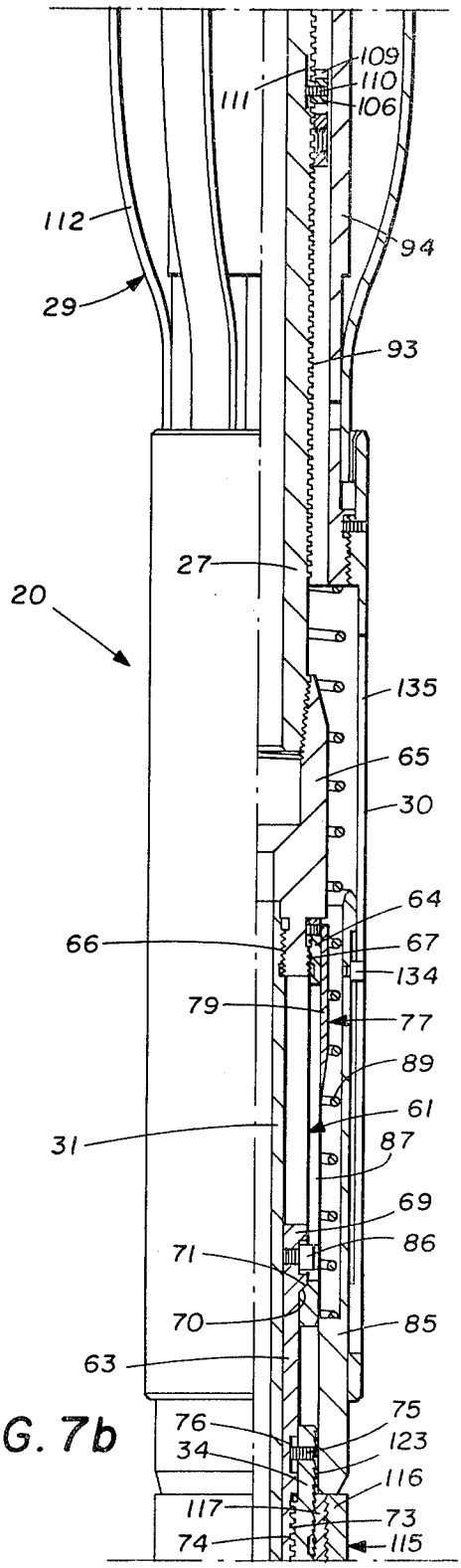
Figure 7C:
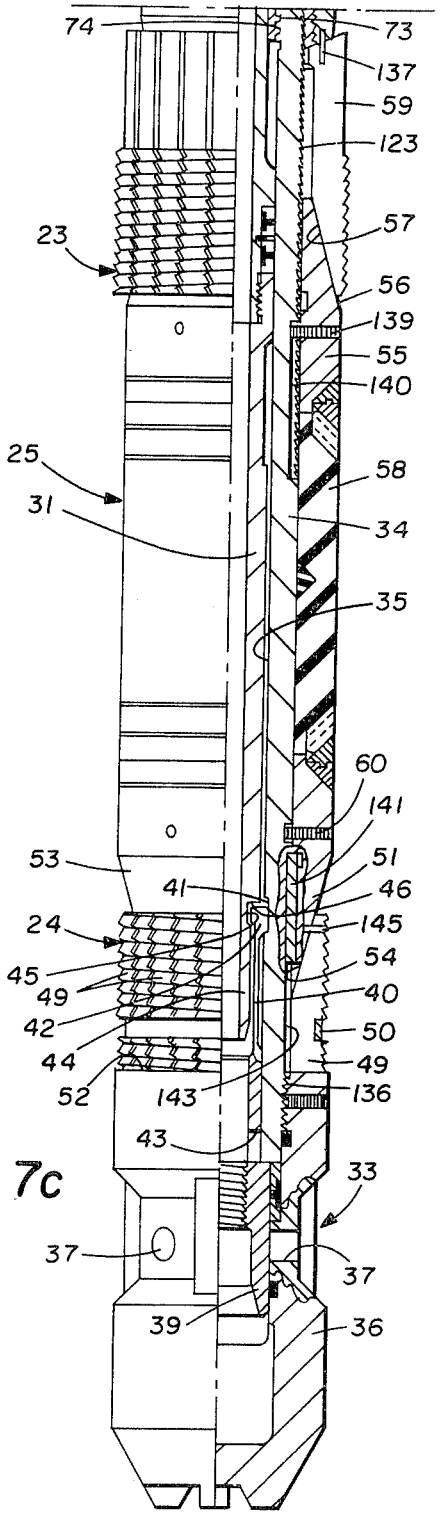

In order to anchor the upper slip set 23 in the casing, the tubing string is pulled upwardly thereby pulling upwardly on the setting-tool mandrel 27 which in turn pulls the valve member 39 into its upper closed position and also pulls the connector housing 64 upwardly so that the connector shoulder 70 and the connector housing shoulder 71 abut each other to transmit lifting forces from the setting-tool mandrel 27 to the retainer mandrel 34. More particularly, as shown in FIG. 7, as the actuator 31 is pulled upwardly, the enlarged upper ends of the spring fingers 40 are captivated within the channel 45 so that the valve member 39 is lifted with the actuator. When the enlarged upper ends of the spring fingers 40 register with the annular groove 41 within the retainer mandrel 34, the fingers snap outwardly allowing the actuator to be pulled further upwardly relative to the valve member 39 without further lifting of the valve member. As the actuator is pulled upwardly to close the valve 33, the connector housing 64 also is pulled upwardly relative to the connector 63. Upon moving initially upward, the lower ends 83 of the short slots 81 push upwardly on the lower ends of the spring fingers 80 of the locking collet 79 and thus unseat the fingers from the annular groove 84 in the enlarged upper end 69 of the connector 63. As shown in FIG. 5, previous movement of the follower downwardly frees the fingers 80 to unseat from the annular groove 84. With further upward movement of the connector housing 64, the projections 86 slide downwardly within the elongated slots 87 until the shoulders 70 and 71 abut each other.

Coincident with the abutting of the shoulders 70 and 71, the valve member 39 reaches its upper closed position and further lifting on the tubing string causes lifting force to be transmitted through the setting-tool mandrel 27 and the connector housing 64 to the retainer mandrel 34.

Thereafter, additional upward pulling on the setting-tool mandrel 27 is transmitted from the retainer mandrel 34 through a threaded connection 136 between the retainer mandrel 34 and the valve housing 36, through the valve housing and the abutment between the lower slip set 24 and the valve housing, through the segments of the lower slip set, to the lower expander head 51 and thence to the upper expander head 55 so that the frusto-conical surface 56 thereof wedges the upper slip segments 59 outwardly to embed within the casing. With forces being transmitted in the foregoing fashion, it will be appreciated that significant wedging forces are generated between the upper expander head and the upper slip segments as the packing sleeve 58 is compressed. Normally, compression of the packing sleeve, to seal against the casing occurs as the retainer mandrel is lifted but before the frangible pin 60 connecting the lower expander head 51 with the retainer mandrel 34 is broken. As compression of the packing sleeve is completed both the frangible pin 60 and the frangible retaining band 50 for the lower slip segments break so that additional upward force on the retainer mandrel anchors the lower slip segments in the casing. Relative movement of parts of the lower slip set 24 and compaction of the packing sleeve 58 is shown in FIG. 8. As the band and pin break, the segments 49 in the lower slip set 24 are wedged outwardly by the valve housing 36 as it is pulled upwardly with the retainer mandrel 34. Thus, both the upper and lower slip sets are anchored in the casing to support the retainer against movement in either direction. During all of the movement of the retainer mandrel 34 upwardly within the casing, the coil spring 89 urges the follower 85 downwardly against the slip lock 115 so that the slip lock is easily held in engagement with the upper end of the upper slip set 23.

One of the primary advantages in the construction of the exemplary drillable cement retainer and setting tool assembly 20, resides in the ability to test both the tubing string and the tubing annulus subsequent to setting both the slip sets 23 and 24 but before disconnecting the setting tool and retainer mandrels 27 and 34 from each other. This testing is possible even though the cement valve 33 is held open during run-in because the valve is closed as an incident to anchoring the slips in the casing. In the event that testing reveals leakage across the elastomeric packing sleeve 58, the tubing string may be pulled upwardly to further set the slips and additionally compress the packing to seal more tightly against the casing.

After testing, the setting tool 21 is disconnected from the cement retainer 25 to spot cement in the tubing string. This is done to avoid driving well fluid in the tubing string through the cement retainer and into the formation where the casing is to be cemented. With the valve actuator 31 retracted, upwardly from the cement retainer, cement may be pumped into the upper end of the tubing string and downwardly to the setting tool. By measuring the volume of well fluid displaced from the annulus between the tubing string and the casing, the position of the cement vertically within the tubing string may be determined fairly accurately so that when the setting tool is recoupled with the cement retainer, only a small quantity fluid need be pumped through the cement retainer before cement is delivered to the casing section to be cemented.

In order to separate the setting tool 21 from the cement retainer 25, the connector 63 is turned loose from the retainer mandrel 34 by rotation of the tubing string in the right hand direction. Because the threaded sections 73 and 74 on the connector and retainer mandrel, respectively, are left-handed, right-hand rotation of the setting-tool mandrel 27 will cause the connector shear pin 75 to be broken and the connector 63 to thread upwardly relative to the retainer mandrel 34. In rotating the setting-tool mandrel 27, torque is transmitted from the setting tool mandrel to the adapter 65, through the adapter to the connector housing 64 and through the housing and the projections 86 to the connector 63. By pulling slightly upwardly on the tubing string while rotating, the operator at the well head can receive an indication of the disconnection of the connector from the retainer mandrel through a loss of weight on the weight indicator at the well head. Thereafter, the tubing string may be lifted a short distance to move the valve actuator 31 out of engagement with the retainer mandrel for spotting cement in the well.

Advantageously, when the setting tool is again lowered to telescope the actuator 31 into the retainer mandrel 34, the connection 61 is not made between the threaded sections 73 and 74. Instead, as the setting tool is lowered the lower end of the connector 63 abuts the retainer mandrel 34 owing to the interference between the threaded sections 73 and 74. The projections 86 thus slide upwardly within the elongated slots 87 in the connector housing 64 until the lower end of the connector housing abuts the upper end of the retainer mandrel. Simultaneously therewith, the actuator 31 slides the valve member 39 into its open position for cement to flow through the retainer into the section of the casing to be cemented. One advantage of this arrangement is that the valve member 39 may be open without having to reconnect the setting tool with the retainer, so that when cementing is completed, the setting tool may be quickly removed from the retainer by simply pulling upwardly on the tubing string, both to free the setting tool 21 from the retainer 25 and simultaneously move the valve member 39 into its closed position.

After the cement has been allowed to harden in the well, a milling tool (not shown), may be lowered into the well to mill through the cement retainer 25 and the cemented section of the casing, thereby leaving the casing sealed by the cement closing the leaks or perforations. For ease in milling, the cement retainer 25 is constructed of parts which are uniquely held together against relative rotation so that the parts of the retainer are kept from sliding or rotating relative to each other during milling. Toward this end as shown in FIG. 9, the set lock 115 includes a plurality of longitudinally extending pins 137 interspaced with the upper slip segments 59 so that the slip lock is held against rotation relative to the upper slip set 23. More particularly, the pins are secured to the collar 116 and project downwardly therefrom into the spaces between the slip segments 59. Additional anti-rotational means is provided between the retainer mandrel 34 and the upper expander head 55 by a plurality of angular set screws 139 extending radially inward from the upper expander head 55 into elongated slots 140 formed in the exterior of the retainer mandrel 34. The slots 140 are of a sufficient length in a longitudinal direction to allow for the expander head 55 to slide downwardly relative to the mandrel without shearing of the set screws 139. Still further anti-rotational means is provided by a rectangular key 141 seated within the lower expander head 51 and extending radially inward into a second elongated slot 143 in the exterior surface of the retainer mandrel 34. This second slot also is of sufficient length longitudinally to allow for movement of the lower expander head relative to the retainer mandrel. Additionally, a plurality of radially extending pins 145 secured to the lower expander head 51 extend into the spaces between the lower slip segments 49 to prevent relative rotation between such segments in the lower expander head. With the foregoing described construction of the retainer 25, milling of the cement retainer is made easier by keeping the various parts of the retainer from being rotated relative to each other.

In view of the foregoing, it will be appreciated that the drillable cement retainer and setting tool assembly 20 of the present invention is substantially easier to use than any prior similar assembly in enabling the cement retainer 25 to be quickly run into the well, set and sealed, tested for leaks and further sealed, quickly and easily disconnected from the setting tool, and, after spotting cement, reconnected in a manner allowing for a single-action, straight-pull release of the setting tool all while assuredly opening and closing the retainer valve 33 at the appropriate times.

The embodiments of the invention in which an exclusive property or privilege is claimed are defined as follows:

1. In a well tool assembly comprising a drillable cement retainer having upper and lower slip sets with a packing element therebetween and a cement valve connected to a mandrel, a setting tool with a tubular member having a valve actuator with one end connected thereto and the other end connected to said valve, a retaining sleeve supported on said tubular member and telescoped over a portion of said upper slip set to hold said latter set against being deployed, means for sliding said sleeve into a release position for said upper set to deploy, and a connection between said retainer mandrel and said tubular member of said setting tool for transmitting lifting force for setting said slip sets and for shifting said actuator to open and close said valve, wherein the improvement comprises said connection having a tubular connector with a lower end threadably coupled with said retainer mandrel to be rotated loose from said mandrel subsequent to setting said slip sets and pressure testing said packing element for leakage, an upper end slidably and non-rotatably connected to said tubular member for limited sliding movement relative thereto in an axial direction, and a releasable locking mechanism normally securing said upper end of said connector to said tubular member against said limited sliding movement and movable only after deployment of said upper slip set to release said upper end for such movement.

2. A well tool assembly for cementing a section of casing in a well comprising, a drillable cement retainer having a first tubular mandrel with a valve connected thereto, upper and lower slip sets mounted on said mandrel above said valve, upper and lower heads mounted on said first mandrel between and adjacent said upper and lower slip sets, respectively, a yieldable packing element disposed around said mandrel and between said heads to be compacted therebetween as said slip sets are deployed and wedged between the casing and said heads to anchor the retainer in the well, a setting tool having a second tubular mandrel, retaining means connected to and carried by said second mandrel and movable relative thereto between a raised and a lowered position wherein said retaining means acts to hold said upper slip set against deployment, an actuator connected between said second mandrel and said valve and serving to open and close said valve as said setting tool mandrel is moved relative to said first mandrel subsequent to deployment of said upper slip set, and a connection between said cement retainer and said setting tool to support said retainer and said tool against relative axial movement during lowering of the assembly into the casing, to allow such relative movement when deploying said slip sets and to permit separation of said setting tool from said retainer after the slips are deployed, said connection including, a tubular connector having one end threadably secured to one of said tubular mandrels and an opposite end slidably and non-rotatably connected to the other of said tubular mandrels for limited movement in an axial direction relative to said other of said mandrels, and a releasable locking mechanism normally securing said connector to said other of said mandrels against said sliding movement and releasing said connector for such relative sliding movement only after deployment of said upper slip set.

3. A well tool assembly as defined by claim 2 wherein said connection further includes a connector housing extending between said first and second mandrels and having an upper end connector to said mandrel, said connector housing being telescoped with said connector, a longitudinal slot formed in one of said connector and said connector housing, a boss secured to the other of said connector and said connector housing and extending into said slot, said slot having a length at least equal to the distance moved by said actuator in moving said valve from its open position into its closed position.

4. A well tool assembly as defined by claim 3 wherein said releasable locking member is a locking collet including fingers movable between catch and release positions relative to said mandrel connector and said connector housing, said connection further including means for locking said collet fingers in their catch positions so said mandrel connector and said mandrel connector housing are held against movement relative to each other.

5. A well tool assembly as defined by claim 4 wherein said means for locking said collet fingers in their catch positions comprises a cylindrical member telescoped over said second mandrel and being slidable thereupon between a first position blocking said collet fingers against moving from their catch positions and a second position freeing said fingers for movement from said catch positions.

6. A well tool assembly as defined by claim 5 including means for moving said cylindrical member from its first position to its second position as an incident to deploying said upper slip set.

7. A well tool assembly as defined by claim 6 wherein said retaining means includes a retaining sleeve telescoped over said second mandrel and surrounding said cylindrical member, said sleeve having a lower end portion also for surrounding a portion of said upper slip set to keep said set from being deployed as said cement retainer is lowered into said well with said setting tool, said sleeve being movable between raised and lowered positions on said stinger, and said means for moving said cylindrical member from its first position to its second position including a spring acting between said cylindrical member and said sleeve to urge said cylindrical member toward its second position when said sleeve is raised for deploying said upper slip set.

8. A well tool assembly as defined by claim 3 wherein the length of said slot in said connector housing is at least equal to the distance of movement of said actuator in moving said valve from one position to the other plus the length of mating between said threaded section on said connector and a corresponding threaded section on said connector and said first mandrel.

9. A well tool assembly as defined by claim 4 wherein said collet is telescoped over said connector housing, said housing having diametrical openings on opposite sides thereof and said fingers of said collet projecting toward each other through said openings, said connector having an annular groove formed in an upper end portion thereof and said fingers being seated within said groove when holding said mandrel connector against movement downwardly within said connector housing.

10. A well tool assembly as defined by claim 9 wherein connector includes an annular shoulder integrally formed therewith adjacent the upper end thereof and projecting outwardly therefrom, said connector housing including an abutting shoulder integrally formed with the interior thereof and located below the lower end of said slot for engagement with said connector shoulder to support said connector in a force transmitting position within said housing.

11. A well tool assembly as defined by claim 10 wherein said connector housing includes a lower end face abutting an upper end face of said first mandrel in said retainer when said valve is open.

12. A slip deployment mechanism for use in conjunction with a well tool adapted to be anchored in the casing of a well by means of a slip set carried on a mandrel in the well tool, said mechanism comprising, a setting-tool mandrel having one end adapted for connection to a tubing string, a connector with one end secured to the other end of said setting-tool mandrel and an opposite end, adapted to be secured to said mandrel in the well tool, a drag mechanism mounted on said setting-tool mandrel and including a friction member engagable with the casing to resist rotational movement relative thereto, a slip retaining sleeve connected with said drag mechanism for movement therewith, a carrier connected between said drag mechanism and said setting-tool mandrel to support said drag mechanism on said setting-tool mandrel for movement upwardly as said setting-tool mandrel is rotated relative to said drag mechanism from a run-in position with said retaining sleeve telescoped over said slip set to a setting position with said sleeve disposed above said slip set, said carrier including radially resilient means connected between said sleeve and said setting-tool mandrel for flexing radially relative to said sleeve and said setting-tool mandrel to avoid jamming as said setting-tool mandrel is rotated for said carrier to shift said sleeve upwardly relative to said setting-tool mandrel, and means for urging against said slip set to deploy the latter against the interior of said casing when said sleeve is in its second position.

13. A mechanism as defined by claim 12 wherein said setting-tool mandrel includes a spiral guide surface formed thereon, said radially resilient means comprising a plurality of lugs angularly spaced from each other around said setting-tool mandrel adjacent said guide surface, said lugs each having an outer surface connected with said drag mechanism and on inner surface in interfitting engagement with said guide surface, and spring means resiliently urging said lugs into engagement with said guide surface.

14. A mechanism as defined by claim 12 wherein said radially resilient means comprises a plurality of arcuate nut segments angularly spaced from each other around said setting-tool mandrel, and having an inner side and an outer side connected with said drag mechanism, said setting-tool mandrel having an externally threaded section, said inner sides of said segments each including an inner arcuate threaded surface mating with said threaded section, and a spring member connecting said segments together.

15. A mechanism as defined by claim 14 including an opening extending in a generally radial direction in each of said segments, a plurality of projections one associated with each of said openings and having an outward end connected to said drag mechanism and an inward end telescoped slidably into its associated opening for supporting one of segments vertically on said drag mechanism.

16. A mechanism as defined by claim 15 including three of said segments, each with said opening being centrally disposed therein and having upper and lower grooves spaced on opposite sides of said opening and extending laterally across said segment to align endwise with the upper and lower grooves in the next adjacent segment, said spring member being a garter spring and being disposed in the upper ones of said grooves, and a second garter spring disposed in the lower ones of said grooves.

17. A mechanism as defined by claim 14 including an annular abutment integrally formed with said setting-tool mandrel above the upper end of said threaded section for engagement by said nut segments to limit upward movement of said segments on said setting-tool mandrel.

18. A mechanism as defined by claim 17 wherein said abutment is spaced above the upper end of said threaded section a distance slightly greater than the length of one of said segments as measured in an axial direction relative to said setting-tool mandrel.

19. A mechanism as defined by claim 14 including an adjustable stop connected to said setting-tool mandrel beneath said segments, said stop being positionable on said setting-tool mandrel for engagement by said segments to define a lower limit position for said drag mechanism relative to said setting-tool mandrel.

20. A mechanism as defined by claim 19 wherein said stop comprises a ring with an upwardly extending projection integrally formed therewith, and means for securing said ring on said setting-tool mandrel within a limited range of positions, one of said segments including a downwardly extending projection integrally formed therewith for side-to-side engagement with said upwardly extending projection to limit relative rotational movement downward between said segments and said ring.

21. A mechanism as defined by claim 12 wherein said means for urging against said slip set includes a follower slidably latched with said retaining sleeve and a spring acting between said follower and said retaining sleeve to urge said follower away from said sleeve.

22. A mechanism as defined by claim 21 wherein said follower comprises a collet with upwardly extending spring fingers telescoped into said retaining sleeve and a lower end for urging said slip set to deploy, said fingers each including a tip with a catch surface extending radially outwardly upon progressing in a direction toward said lower end, said retaining sleeve including a mating edge slanting radially inward upon progressing in an upward direction relative to said sleeve, said catch surface and mating edge being positioned relative to each other for abutting engagement to support said follower against separation from said sleeve.

23. A mechanism as defined by claim 21, including guide means extending between said follower and said retaining sleeve to lock said follower and said sleeve together against relative rotation.

24. A mechanism as defined by claim 23 wherein said follower comprises a generally cylindrical member telescoped into said retaining sleeve and said guide means comprises a projection extending in a generally radial direction outward from said member, an elongated longitudinal slot formed in said retaining sleeve and opening inwardly thereof and receiving said projection.

25. A setting tool for use in conjunction with a well tool adapted to be anchored in the casing of a well by means of a slip set carried on a mandrel in the well tool, said mechanism comprising, a setting-tool mandrel having one end adapted for connection to a tubing string, a slip-joint connection between said setting-tool mandrel and said mandrel in the well tool to support said mandrel in well tool and said setting-tool mandrel against relative axial movement during lowering of the assembly into the casing, to allow such relative movement when deploying the slip set and to permit separation of the setting tool from the well tool after the slip set is deployed, said connection including, a tubular connector having one end threadably secured to one of said mandrels and an opposite end slidably and non-rotatably connected to the other of said mandrels for limited movement in an axial direction relative to said other of said mandrels, a releasable locking mechanism normally securing said connector to said other of said mandrels against said sliding movement and releasing said connector for such relative sliding movement only after deployment of said slip set, a drag mechanism mounted on said setting-tool mandrel and including a friction member engagable, with the casing to resist rotational movement relative thereto, a slip retaining sleeve connected with said friction member for movement therewith, a carrier connected between said drag mechanism and said setting-tool mandrel to support said drag mechanism on said setting-tool mandrel for movement upwardly, as said setting-tool mandrel is rotated relative to said drag mechanism from a run-in position with said retaining sleeve telescoped over said slip set to a setting position with said sleeve disposed above said slip set, said carrier including radially resilient means connected between said sleeve and said setting-tool mandrel for flexing radially relative to said sleeve and said setting-tool mandrel to avoid jamming as said setting-tool mandrel is rotated for said carrier to shift said sleeve upwardly relative to said setting-tool mandrel, and means for urging against said slip set to deploy the latter against the interior of said casing when said sleeve is in its second position.

26. A setting tool as defined by claim 25 wherein said slip-joint connection further includes a connector housing extending between said well-tool and setting-tool mandrels and having an upper end connected to said setting-tool mandrel, said connector housing being telescoped with said connector, a longitudinal slot formed in one of said connector and said connector housing, a boss secured to the other of said connector and said connector housing and extending into said slot, said slot having a length somewhat greater than the distance moved by said actuator in moving said valve from its open position into its closed position.

27. A setting tool as defined by claim 26 wherein said releasable locking member is a locking collet including fingers movable between catch and release positions relative to said mandrel connector and said connector housing, said connection further including means for locking said collet fingers in their catch positions so said mandrel connector and said mandrel connector housing are held against movement relative to each other.

28. A setting tool as defined by claim 27 wherein said means for urging said slip set to deploy includes a follower slidably latched with and disposed within said retaining sleeve and outwardly of said locking collet, said means for locking said collet fingers in their catch positions comprising a lower end portion of said follower located between said locking collet and the inside of said retaining sleeve, and being slidable relative to said collet between a first position blocking said collet fingers against moving from their catch positions and a second position freeing said fingers for movement from said catch positions.

29. A setting tool as defined by claim 28 including a spring disposed between said retaining sleeve and said follower and urging said follower away from said sleeve.

30. A setting tool as defined by claim 28 including guide means extending between said follower and said retaining sleeve to lock said follower and said sleeve together against relative rotation.

31. A setting tool as defined by claim 30 wherein said follower comprises a generally cylindrical member telescoped into said retaining sleeve and said guide means comprises a projection extending in a generally radial direction outward from said member, and elongated longitudinal slot formed in said retaining sleeve and opening inwardly thereof and receiving said projection.

32. A setting tool as defined by claim 25 or 28 wherein said radially resilient means comprises a plurality of arcuate segments angularly spaced from each other around said setting-tool mandrel, and each having an inner side and an outside connected with said drag mechanism threaded section, said inner sides of said segments each including an inner arcuate threaded surface mating with said threaded section, and a spring member connecting said segments together.

33. A setting tool as defined by claim 32 including an opening extending in a generally radial direction within each of said segments, a plurality of projections one associated wtih each of said openings and having an outward end connected to said drag mechanism and an inward end telescoped slidably into its associated opening for supporting one of said segments vertically on said drag mechanism.

34. A setting tool as defined by claim 33 including three of said segments, each with said opening being centrally disposed therein and having upper and lower grooves spaced on opposite sides of said opening and extending laterally across said segment to align endwise with the upper and lower grooves in the next adjacent segment, said spring member being a garter spring and being disposed in said upper grooves, and a second garter spring disposed in said lower grooves.

35. A setting tool as defined by claim 32 including an annular abutment integrally formed with said setting-tool mandrel above the upper end of said threaded section for engagement by said nut segment to limit upward movement of said segments on said setting-tool mandrel.

36. A setting tool as defined by claim 35 wherein said abutment is spaced above the upper end of said threaded section a distance slightly greater than the length of one of said segments as measured in an axial direction relative to said setting-tool mandrel.

37. A setting tool as defined by claim 32 including an adjustable stop connected to said setting-tool mandrel beneath said segments, said stop being positionable on said setting-tool mandrel for engagement by said segments to define a lower limit position for said drag mechanism relative to said setting-tool mandrel.

38. A well tool assembly including a setting tool for anchoring a well tool in a set condition in the casing of a well, said well tool including a well-tool mandrel, upper and lower slip sets mounted on said well-tool mandrel, upper and lower heads mounted on said well-tool mandrel between and adjacent said upper and lower slip sets, respectively, for movement toward each other, a flexible packing element disposed around said well-tool mandrel and between said heads to be compacted therebetween as said heads are slid toward each other and said slip sets are deployed and wedged between the casing and said heads to anchor the well tool in the well, a setting tool having a setting-tool mandrel, a connection between said setting-tool mandrel and said mandrel for transmitting slip-setting force from said setting-tool mandrel to said well-tool mandrel and to permit separation of the setting tool from the well tool after the slip set is anchored in the casing, a drag mechanism mounted on said setting-tool mandrel and including a friction member engageable with the casing to resist rotational movement relative thereto, a slip retaining sleeve connected with said friction member for movement therewith, a carrier connected between said drag mechanism and said setting-tool mandrel to support said drag mechanism on said setting-tool mandrel for movement upwardly, as said setting-tool mandrel is rotated relative to said drag mechanism from a run-in position with said retaining sleeve telescoped over said slip set to a setting position with said sleeve disposed above said slip set, a longitudinally-acting spring mounted between said drag mechanism and said upper slip set and urging said upper set toward an initially set position in engagement with both said upper head and the interior wall of the casing when said slip retainer is moved into its setting position, and means for locking said well tool in its set condition in said well including a collar concentrically mounted on said well-tool mandrel above said upper slip set and urged downwardly toward said set by said setting spring, a ratchet ring disposed within said collar around said well-tool mandrel and being resiliently flexible in a radial direction within said collar, one-way ratchet-toothed surfaces on said mandrel, said ratchet ring and said collar and limiting relative longitudinal movement between said ratchet ring and said well-tool mandrel to a single direction in response to a longitudinally applied force by said setting spring to move in the direction of said applied spring force, and means within said ring for adjustment in the radial flexibility thereof to set the magnitude of said longitudinally applied force for initially deploying said slip set into said initially set position.

39. A well tool assembly as defined by claim 38 wherein said means within said ring for radial flexibility adjustment includes a first gap formed completely through said ring and extending in a generally longitudinal direction from one end of said ring to the other, a first slit extending partially through said ring in a generally longitudinal direction from said one end of said ring and toward the other end thereof.

40. A well tool assembly as defined by claim 39 further including second and third slits extending partially through said ring in a generally longitudinal direction from said other end of said ring and toward said one end thereof, said slits each extending longitudinally for a distance somewhat greater than one-half the longitudinal length of said ring, and being angularly spaced from each other.

41. A well tool assembly as defined by claim 38 or 40 wherein said one-way, ratchet-toothed surfaces include first and second interlocking surfaces of a predetermined small tooth size on said exterior of said well-tool mandrel and the interior of said ratchet ring, respectively, and third and fourth interlocking surfaces of a tooth size larger than said small tooth size on the exterior of said ratchet ring and the interior of said collar, respectively, for said ratchet ring to flex radially without said third and fourth surfaces moving longitudinally relative to each other while said first and second surfaces are movable relative to each other in said one direction of said longitudinally applied spring force.

42. A well tool assembly mechanism as defined by claim 38 further including a follower slidably latched with said retaining sleeve and having a lower end portion abutting said collar, said setting spring acting between said follower and said retaining sleeve to urge said follower against said collar.

43. A well tool assembly as defined by claim 42 wherein said follower comprises a collet with upwardly extending spring fingers telescoped into said retaining sleeve from said lower end portion, said fingers each including a tip with a catch surface extending radially outwardly upon progressing in a direction toward said lower end, said retaining sleeve including a mating edge slanting radially inward upon progressing in an upward direction relative to said sleeve, said catch surface and mating edge being positioned relative to each other for abutting engagement to support said follower against separation from said sleeve.

44. A well tool assembly as defined by claim 43 wherein said setting-tool mandrel includes a spiral guide surface formed thereon, said radially resilient means comprising a plurality of lugs angularly spaced from each other around said setting-tool mandrel adjacent said guide surface, said lugs each having an outer surface connected with said drag mechanism and on inner surface in interfitting engagement with said guide surface, and spring means resiliently urging said lugs into engagement with said guide surface.

45. A well tool assembly as defined by claim 38 wherein said upper slip set includes a plurality of slip segments angularly spaced from each other, said collar having a plurality of pins connected thereto and extending in a longitudinal direction therefrom into the angular spaces between said slip segments.

46. A well tool assembly as defined by claim 45 further including first and second non-rotatable, longitudinally-slidable couplings between said upper and lower heads, and said well-tool mandrel, respectively.

47. A well tool assembly for cementing a section of casing in a well comprising:

a drillable cement retainer having, an elongated retainer mandrel having an axial passage therethrough, a cementing valve on said retainer mandrel for opening and closing said passage to fluid flow through said retainer mandrel, said valve including a housing securing the lower end of said retainer mandrel and having a valve port therein, a valve member disposed within said housing and movable between open and closed positions relative to said valve port, a lower slip set including a plurality of angularly spaced segments disposed around said retainer mandrel and slidably supported thereon by engagement with said valve housing, a lower expander head telescoped onto said retainer mandrel and into abutting engagement with said lower slip set for wedging said segments radially outward into anchoring engagement with said casing, a first slide coupling connected between said retainer mandrel and said lower expander head to hold said lower head against rotation relative to said retainer mandrel while permitting said mandrel to slide upwardly within said lower head when setting said slip segments, a first stop connected between said lower expander head and said slip set for preventing relative rotation between said lower expander head and said lower slip set, a compressible packing sleeve telescoped over said retainer mandrel above said lower expander head and into abutting engagement therewith, a first frangible element connected between said retainer mandrel and said lower expander head primarily to avoid premature compression of said packing sleeve when lowering the retainer to a specified position in the well, an upper expander head telescoped onto said retainer mandrel above said packing sleeve and into abutting engagement therewith, a second slide coupling connected between said retainer mandrel and said upper expander head to hold said upper head against rotation relative to said retainer mandrel while permitting said retainer mandrel to slide upwardly with said upper head when setting said slip segments, an upper slip set including a plurality of angularly spaced segments disposed around said retainer mandrel above said upper expander head for being wedged thereby radially outward of said retainer mandrel into anchoring engagement with said casing, a set lock connected to said retainer mandrel above said upper slip set for one-way sliding movement downwardly thereon to secure against relative upward movement of said upper slip set on said retainer mandrel for locking said retainer in its set condition, a second stop connected between said set lock and said upper slip set for preventing relative rotation therebetween, and a setting tool including, an elongated, setting-tool mandrel with an axial bore therethrough, a tubular adapter connected to the lower end of said setting-tool mandrel, a tubular actuator connected to the lower end of said adapter and extending in an axial direction through said axial passage in said retainer and into said valve housing, a releasable latch connecting said actuator and said valve member together for movement of said actuator between spaced vertical positions relative to said retainer mandrel to open and close said valve port and for releasing from said valve member with said valve member in its closed position to enable said actuator to be pulled from said retainer mandrel after setting said retainer in the well, a slip-joint connection between said adapter and said retainer mandrel for transmitting slip-setting force from said setting-tool mandrel to said retainer mandrel when said valve is closed, while allowing said setting-tool mandrel to be moved vertically to shift said valve member between its closed and open positions without transmitting slip-setting force to axial retainer mandrel from said setting tool mandrel, said connection including a connector with a lower end threadably coupled with said retainer mandrel and an upper end slidably and non-rotatably, connected to said adapter, a releasable locking mechanism normally securing said upper end of said connector to said adapter against said sliding movement and releasing said upper end for such movement only after deployment of said upper slip set, and a second frangible element connected between said connector and said retainer mandrel to keep said lower end portion from being inadvertently uncoupled from said retainer mandrel by relative rotation therebetween, a drag mechanism mounted on said setting-tool mandrel and including a friction member engageable with said casing to resist rotational movement relative thereto, a slip-retaining sleeve, telescoped over said setting-tool mandrel and connected to said drag mechanism for movement therewith, said slip retaining sleeve being movable from a run-in position with a lower end portion of said sleeve surrounding an upper portion of said upper slip set to a setting position with said lower end portion disposed above said upper slip set to free said slip set for anchoring in the casing, a generally cylindrical follower telescoped onto setting-tool mandrel radially inwardly of said retaining sleeve and radially outwardly of said releasable locking mechanism of said slip-joint connection, said follower having an upper end portion slidably latched with said retaining sleeve and a lower end portion abutting said upper slip set, a setting spring captivated within said drag mechanism between said follower and said retaining sleeve and urging said follower axially away from said sleeve and into engagement with said upper slip set to urge said segments of said upper slip set into a setting position wedged between said upper head and said casing when said retaining sleeve is retracted upwardly into its setting position, and a carrier connected between said drag mechanism and said setting-tool mandrel to support said drag mechanism on said setting-tool mandrel for movement upwardly, as said setting-tool mandrel is rotated relative to said drag mechanism from a run-in position with said retaining sleeve telescoped over said upper slip set to a setting position with said retaining sleeve disposed above said slip set, said carrier including radially resilient means connected between said sleeve and said setting-tool mandrel for flexing radially relative to said sleeve and said setting-tool mandrel to avoid jamming as said setting-tool mandrel is rotated for said carrier to shift said sleeve upwardly relative to said setting-tool mandrel, a spiral guide surface integrally formed with said setting-tool mandrel for interfitting engagement with said radially resilient means for causing said carrier to lift said drag mechanism upwardly relative to said setting-tool mandrel upon rotation of said mandrel in one direction so that said retaining sleeve is lifted into its slip set position for said setting spring to urge said follower downwardly to in turn wedge said upper slip set into engagement with the casing so that thereafter an upward pull on the setting-tool mandrel will sequentially close the valve and anchor the upper and lower slip sets in the casing.

48. A setting tool for use in conjunction with a well tool having a closable valve connected to a well-tool mandrel adapted to be anchored in the casing of a well by means of upper and lower slip sets carried on the mandrel, said setting tool comprising:

an elongated, setting-tool mandrel with an axial bore therethrough, a tubular adapter connected to the lower end of said setting-tool mandrel, a tubular actuator connected to the lower end of said adapter and extending in an axial direction through said well tool to connect with said valve for opening and closing said valve as said actuator is moved between spaced vertical positions relative to said well tool, a slip-joint connection between said adapter and said well-tool mandrel for transmitting slip-setting force from said setting-tool mandrel to said well-tool mandrel when said valve is closed, while allowing said setting-tool mandrel to be moved vertically to shift said valve between its closed and open positions without transmitting slip-setting force to said well-tool mandrel from said setting-tool mandrel, said connection including a connector with a lower end threadably coupled with said mandrel and an upper end slidably and non-rotatably connected to said adapter, a releasable locking mechanism normally securing said upper end of said connector to said adapter against such sliding movement and releasing said upper end for such movement only after deployment of said upper slip set, and a frangible element for connection between said connector and said setting-tool mandrel to keep said lower end of said connector from being inadvertently uncoupled from said well-tool mandrel, a drag mechanism mounted on said setting-tool mandrel and including a friction member engageable with the well casing to resist rotational movement relative thereto, a slip-retaining sleeve telescoped over said setting-tool mandrel and said drag mechanism for movement therewith, said slip-retaining sleeve being movable from a run-in position with a lower end portion of said sleeve surrounding an upper portion of said upper slip set to a setting position with said lower end portion disposed above said upper slip set to free said slip set for anchoring in the casing, a generally cylindrical follower telescoped onto said setting-tool mandrel radially inwardly of said retaining sleeve and radially outwardly of said releasable locking mechanism, said follower having an upper end portion slidably latched with said retaining sleeve, and a lower end portion for abutting said upper slip set, a setting spring captivated within said drag mechanism between said follower and said retaining sleeve for urging said follower axially away from said sleeve and into engagement with said upper slip set to urge said segments of said upper slip set into a setting position wedged between said upper head and said casing when said retaining sleeve is retracted upwardly into its setting position, a carrier connected between said drag mechanism and said setting-tool mandrel to support said drag mechanism on said setting-tool mandrel for movement upwardly, from a run-in position with said retaining sleeve telescoped over said upper slip set to a setting position with said retaining sleeve disposed above said slip set as said setting-tool mandrel is rotated relative to said drag mechanism, said carrier including radially resilient means connected between said sleeve and said setting-tool mandrel for flexing radially relative to said sleeve and said setting-tool mandrel to avoid jamming as said setting-tool nandrel is rotated for said carrier to shift said sleeve upwardly relative to said setting-tool mandrel, and a spiral guide surface integrally formed with said setting-tool mandrel for interfitting engagement with said radially resilient means for causing said carrier to lift said drag mechanism upwardly relative to said setting-tool mandrel upon rotation of said mandrel in one direction so that said retaining sleeve is lifted into its slip set position for said setting spring to urge said follower downwardly for in turn wedging said upper slip set into engagement with the casing so that thereafter an upward pull on the setting-tool mandrel will sequentially close the valve and anchor the upper and lower slip sets in the casing.

49. A setting tool for use in conjunction with a well tool adapted to be anchored in the casing of a well by means of a slip set carried on a well-tool mandrel, said setting tool comprising, an elongated setting-tool mandrel with an axial bore therethrough, means for connection between said well-tool mandrel and said setting-tool mandrel for transmitting slip-setting force from said setting-tool mandrel to said well-tool mandrel to anchor said slip set and for thereafter releasing said setting-tool mandrel from said well-tool mandrel, a drag mechanism mounted on said setting-tool mandrel and including a friction member engageable with said casing to resist rotational movement relative thereto, a slip-retaining sleeve telescoped over said setting-tool mandrel and connected to said drag mechanism for movement therewith, said slip retaining sleeve being movable from a run-in position with a lower end portion of said sleeve surrounding an upper portion of said slip set to a setting position with said lower end portion disposed above said upper slip set and freeing said slip set to be anchored in the casing, a generally cylindrical follower telescoped onto said setting-tool mandrel radially inwardly of said retaining sleeve and radially outwardly of said means for connection, said follower having an upper end portion slidably latched with said retaining sleeve and a lower end portion for abutting said slip set, a setting spring captivated within said drag mechanism between said follower and said retaining sleeve for urging said follower axially away from said sleeve and into engagement with said slip set to urge said segments of said slip set into a setting position wedged against said casing when said retaining sleeve is retracted upwardly into its setting position, a carrier connected between said drag mechanism and said setting-tool mandrel to support said drag mechanism on said setting-tool mandrel for movement upwardly, as said setting-tool mandrel is rotated relative to said drag mechanism from a run-in position with said retaining sleeve telescoped over said slip set to a setting position with said retaining sleeve disposed above said slip set, said carrier including radially resilient means connected between said sleeve and said setting-tool mandrel for flexing radially relative to said sleeve and said setting-tool mandrel to avoid jamming as said setting-tool mandrel is rotated for said carrier to shift said sleeve upwardly relative to said setting-tool mandrel, and a spiral guide surface integrally formed with said setting-tool mandrel for interfitting engagement with said radially resilient means for causing said carrier to lift said drag mechanism upwardly relative to said setting-tool mandrel upon rotation of said mandrel in one direction so that said retaining sleeve is lifted into its slip set position for said setting spring to urge said follower downwardly for in turn wedging said slip set into engagement with the casing so that thereafter an upward pull on the setting-tool mandrel will anchor said slip set in the casing.

* * * * *